US010112798B2

(12) United States Patent
Chevrier et al.

(10) Patent No.: US 10,112,798 B2
(45) Date of Patent: Oct. 30, 2018

(54) SPOOL ASSEMBLY AND METHOD OF USE THEREOF

(71) Applicant: PLOMBCO INC., Salaberry-de-Valleyfield (CA)

(72) Inventors: Maxime Chevrier, Saint-Michel (CA); Mathieu Pare, Beauharnois (CA); Jean Prevost, Notre-Dame-de-l'île-Perrot (CA)

(73) Assignee: PLOMBCO INC., Salaberry-de-Valleyfield (CA)

( * ) Notice: Subject to any disclaimer, the term of this patent is extended or adjusted under 35 U.S.C. 154(b) by 245 days.

(21) Appl. No.: 15/175,475

(22) Filed: Jun. 7, 2016

(65) Prior Publication Data

US 2017/0247218 A1 Aug. 31, 2017

Related U.S. Application Data

(60) Provisional application No. 62/334,181, filed on May 10, 2016.

(51) Int. Cl.

| | |
|---|---|
| ***B65H 49/26*** | (2006.01) |
| ***B65H 75/18*** | (2006.01) |
| ***B65H 75/22*** | (2006.01) |

(52) U.S. Cl.

CPC ..... *B65H 49/26* (2013.01); *B65H 75/182* (2013.01); *B65H 75/22* (2013.01); *B65H 2553/52* (2013.01)

(58) Field of Classification Search

CPC ..... B65H 49/26; B65H 75/22; B65H 75/182; B65H 2553/52

See application file for complete search history.

(56) References Cited

U.S. PATENT DOCUMENTS

| | | | |
|---|---|---|---|
| 2,703,684 | A | 3/1955 | Warfield |
| 3,121,193 | A | 2/1964 | Engelsted |
| 3,190,004 | A | 6/1965 | Land |
| 3,298,730 | A | 1/1967 | Soley |
| 3,319,989 | A | 5/1967 | Ross |

(Continued)

FOREIGN PATENT DOCUMENTS

| | | |
|---|---|---|
| DE | 000019922085 | 12/2000 |
| DE | 19922085 | 12/2000 |

(Continued)

OTHER PUBLICATIONS

International Search Report of PCT/EP2014/050912, published in Jul. 2009 by Pieter Jan Kramer officer of the European Patent Office.

(Continued)

*Primary Examiner* — Sang K Kim
(74) *Attorney, Agent, or Firm* — Mathieu Audet

(57) ABSTRACT

A spool, presented herein, is comprising a proximal side including a central opening about a rotation axis thereof, a distal side including a central opening about the rotation axis thereof, the proximal side and the distal side being assembled together with alignment of the rotation axis thereof, an axial slot radially extending from the central opening and a recessed portion communicating with the central opening, the recessed portion extending between the axial slot and a locking member receiver. A method of using same and a mechanism to engage lock and actuate the spool is also presented therein.

16 Claims, 22 Drawing Sheets

(56) References Cited

U.S. PATENT DOCUMENTS

| | | | | |
|---|---|---|---|---|
| 3,452,310 | A | 6/1969 | Israelson | |
| 4,101,095 | A | 7/1978 | Carter | |
| 4,250,478 | A | 2/1981 | Cardone | |
| 4,297,930 | A | 11/1981 | Putzke | |
| 5,134,766 | A | 8/1992 | Miller | |
| 5,195,236 | A | 3/1993 | Miechowicki | |
| 5,382,935 | A | 1/1995 | Doyelle | |
| 5,435,613 | A | 7/1995 | Jung | |
| 5,531,399 | A * | 7/1996 | Weisburn | B65H 75/22 242/608.6 |
| 5,676,332 | A | 10/1997 | Kraus | |
| 5,775,634 | A * | 7/1998 | Fettes | B65H 75/22 242/608.6 |
| 5,992,232 | A | 11/1999 | Saitoh | |
| 6,290,164 | B1 | 9/2001 | O'Connor | |
| 6,616,089 | B2 | 9/2003 | Gross | |
| 6,857,595 | B1 * | 2/2005 | Schaefer | B65H 75/22 242/608.5 |
| 6,862,933 | B2 | 3/2005 | Gross | |
| 7,108,222 | B1 * | 9/2006 | Schaefer | B65H 75/22 242/608.6 |
| 7,134,333 | B2 | 11/2006 | Gross | |
| 7,614,582 | B2 | 11/2009 | Hafner | |
| 7,931,342 | B2 | 4/2011 | Spaulding | |
| 8,256,481 | B2 | 9/2012 | Lammlein | |
| 8,336,379 | B2 | 12/2012 | Rogalla | |
| 8,505,423 | B2 | 8/2013 | Hedtke | |
| 8,561,464 | B2 | 10/2013 | Peinelt | |
| 8,769,807 | B2 | 7/2014 | Lawson | |
| 8,943,940 | B2 | 2/2015 | Hedtke, Jr. | |
| 9,290,289 | B2 | 3/2016 | Hedtke, Jr. | |
| 2003/0085315 | A1 | 5/2003 | Rodriguez | |
| 2004/0094263 | A1 | 5/2004 | Middelstadt | |
| 2005/0229702 | A1 | 10/2005 | Haydu | |
| 2006/0016309 | A1 | 1/2006 | Spaulding | |
| 2006/0076359 | A1 | 4/2006 | Gross | |
| 2008/0135676 | A1 | 6/2008 | Hafner | |
| 2008/0272225 | A1 * | 11/2008 | Hein | A22C 11/125 242/602 |
| 2010/0058859 | A1 | 3/2010 | Rogalla | |
| 2010/0154611 | A1 | 6/2010 | Lammlein | |
| 2010/0175522 | A1 | 7/2010 | Hedtke | |
| 2011/0197672 | A1 | 8/2011 | Peinelt | |
| 2011/0283790 | A1 | 11/2011 | Hedtke, Jr. | |
| 2012/0073764 | A1 | 3/2012 | Lawson | |
| 2013/0320686 | A1 | 12/2013 | Morton | |
| 2014/0000432 | A1 | 1/2014 | Hedtke, Jr. | |
| 2014/0367050 | A1 | 12/2014 | Burgel | |
| 2015/0027225 | A1 | 1/2015 | Rogalla | |
| 2015/0090032 | A1 | 4/2015 | Hedtke, Jr. | |
| 2016/0193745 | A1 | 7/2016 | Hedtke, Jr. | |

FOREIGN PATENT DOCUMENTS

| | | |
|---|---|---|
| EP | 1253414 | 11/2005 |
| EP | 1124123 | 7/2008 |
| EP | 2757284 | 7/2014 |
| WO | WO2015168106 | 11/2015 |

OTHER PUBLICATIONS

Written Opinion of the International searching Authority of PCT/EP2014/050912, published in Jul. 2009 by Pieter Jan Kramer officer of the European Patent Office.

International Search Report of PCT/CA2016/000167, published in Jul. 2016 by Jean-Francois Desrosiers officer of the European Patent Office.

Written Opinion of the International searching Authority of PCT/CA2016/000167, published in Jul. 2016 by Jean-François Desrosiers officer of the European Patent Office.

International Search Report (PCT/CA2016/000056); Author Daniel Weslake, Published by WIPO, Publication date Nov. 16, 2016.

Written Opinion of the International Searching Authority (PCT/CA2016/000056); Author Daniel Weslake, Published by WIPO, Publication date Nov. 16, 2016.

* cited by examiner

F9
F12
14
58
104
208
252
256
258
260
262
264
266
268
272
276
280
284

SPOOL ASSEMBLY AND METHOD OF USE THEREOF

CROSS-REFERENCES

The present application is a non-provisional application of, and claims priority under 35 U.S.C. 119(e) to, U.S. provisional patent application No. 62/334,181 filed May 10, 2016, entitled SPOOL-SECURING MECHANISM AND METHOD OF USE THEREOF, filed under 35 U.S.C. 111(b), and PCT application no. PCT/CA2016/000056, filed Feb. 29, 2016, entitled BALANCING WEIGHT APPLICATION MACHINE AND METHOD OF USE THEREOF, which are incorporated herein by reference in their entirety.

FIELD OF THE INVENTION

This invention relates to a spool and mechanism for securing a spool to a shaft. The invention also relates to a method of using same.

BACKGROUND OF THE INVENTION

Spools are used for receiving thereon a strip of parts. The strip of parts can be easily handled with the spool and be provided to a machine for further transformation or installation on a manufactured product. Spools can have various formats and configurations adapted to their intended use. Spools, for instance, can be made of two assembled sides cooperating together to house and wind the strip of parts in a radial overlapping arrangement adapted to be unwinded when parts are required during the manufacturing process.

The two sides of the spool can be made of metallic, plastic or other types of materials suitable for sustaining the required mechanical load applied to the spool. Ideally, the two sides of the spool are made of strong and light material. The spool is generally rotatably secured on a support shaft for winding and unwinding the strip of parts.

Manipulation of spools can be difficult given the weight of the strip winded thereon. Replacement of empty spools might be tedious to keep an assembly line working without having to stop for spool replacement. Spools supporting a heavy strip of parts can also be challenging to actuate without damaging the spool.

Therefore, there is a need in the art for an improved spool and a way to secure the spool on support shaft. A need has been felt to support and manage rotation of the spool with a shaft that can secure the spool thereon. Additionally, there is a need for a spool-securing mechanism that can automatically secure and unsecure a spool thereon.

SUMMARY OF THE INVENTION

It is one aspect of the present invention to alleviate one or more of the drawbacks of the background art by addressing one or more of the existing needs in the art.

The present application is generally concerned, in accordance with at least one embodiment thereof, with a spool-supporting assembly including a spool-engaging member configured to receive and secure thereon a spool.

The present application is generally concerned, in accordance with at least one embodiment thereof, with a spool-supporting assembly capable of rotationally engaging and axially securing the spool.

The present application is also generally concerned, in accordance with at least one embodiment thereof, with a spool-supporting assembly capable of automatically charging and discharging a spool thereon.

An aspect of the present invention provides, in accordance with at least one embodiment thereof, a spool-engaging member adapted to engage, support and lock a spool thereon without human intervention.

An aspect of the present invention provides, in accordance with at least one embodiment thereof, a spool-engaging member rotatably managing the unwinding of a spool thereon.

An aspect of the present invention provides, in accordance with at least one embodiment thereof, a spool-engaging member securing a spool thereon with a partial rotation of the spool in respect with the spool-engaging support.

An aspect of the present invention provides, in accordance with at least one embodiment thereof, a spool-engaging support requiring an axial compression to lock the spool thereon.

An aspect of the present invention provides, in accordance with at least one embodiment thereof, a spool-engaging member that axially compresses the two sides of the spool toward each other for locking the spool thereon.

An aspect of the present invention provides, in accordance with at least one embodiment thereof, a spool including a central opening including a locking member receiver.

An aspect of the present invention provides, in accordance with at least one embodiment thereof, a spool including a distal side and a proximal side axially assembled thereof.

An aspect of the present invention provides, in accordance with at least one embodiment thereof, a spool with a locking mechanism configured to be engaged with a partial rotation of the spool.

An aspect of the present invention provides, in accordance with at least one embodiment thereof, a spool and adaptor assembly allowing to secure the spool on a spool-engaging member via the adaptor.

An aspect of the present invention provides, in accordance with at least one embodiment thereof, a spool designed to sustain rotational torque with an axial slot therein.

An aspect of the present invention provides, in accordance with at least one embodiment thereof, a spool including two similar halves—a distal side and a proximal side.

An aspect of the present invention provides, in accordance with at least one embodiment thereof, a spool including an RFID tag therein.

An aspect of the present invention provides, in accordance with at least one embodiment thereof, a spool sized and designed to wind about 9 kg of goods thereon.

An aspect of the present invention provides, in accordance with at least one embodiment thereof, a spool including a slot therein of about between 5 mm and 8 mm wide.

An aspect of the present invention provides, in accordance with at least one embodiment thereof, a spool including a central opening of between about 15 mm and 18 mm in diameter, and more preferably about 16.8 mm (0.661") in diameter.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Additional and/or alternative advantages and salient features of the invention will become apparent from the following detailed description, which, taken in conjunction with the annexed drawings, disclose preferred embodiments of the invention.

BRIEF DESCRIPTION OF THE DRAWINGS

Referring now to the drawings which form a part of this original disclosure.

DETAILED DESCRIPTION OF PREFERRED EMBODIMENTS

Figure 2:
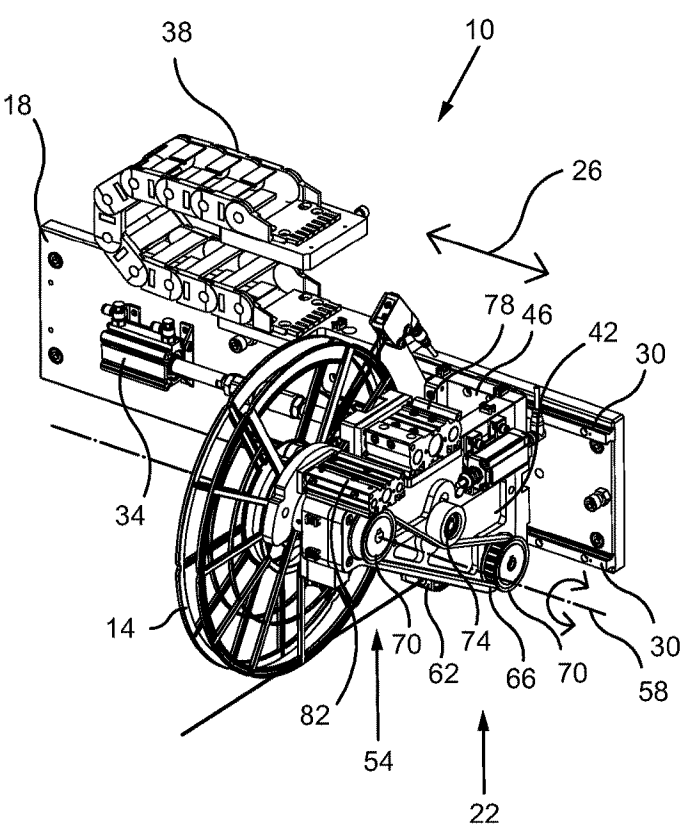
FIG. 2 is a perspective view of a drive mechanism in accordance with at least one embodiment of the invention.
Figure 1:
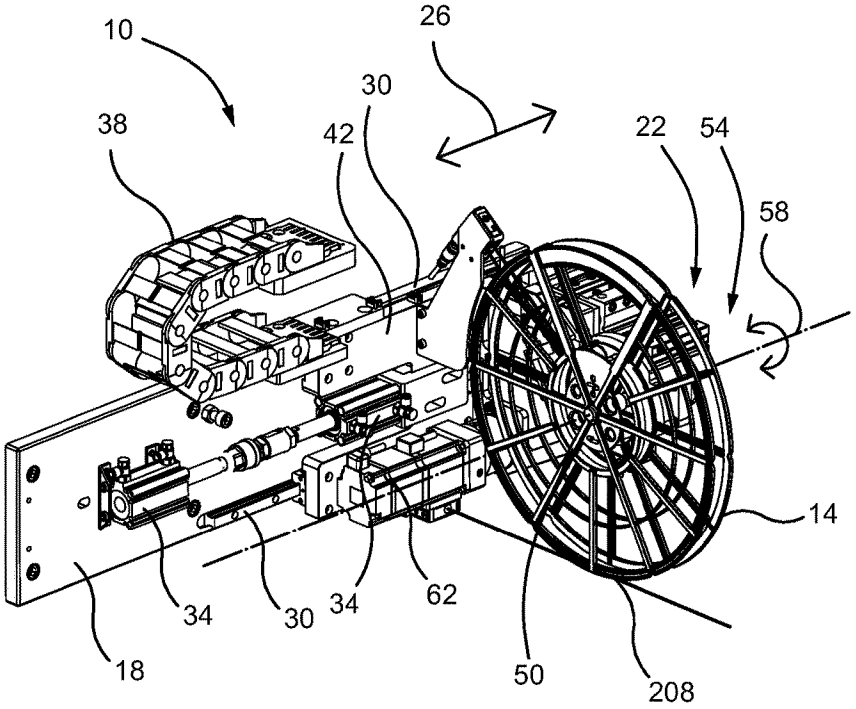
FIG. 1 is a perspective view of a drive mechanism in accordance with at least one embodiment of the invention.

Embodiments of the present invention are described bellow with reference to the appended Figures. An exemplary spool-supporting assembly 10 with a spool 14 secured thereon is illustrated in FIG. 1 and FIG. 2. The illustrated spool 14 contains about 9 kg (20 pounds) of material therein and is configured to be manipulated automatically or manually by an operator. The spool-supporting assembly 10 includes a supporting frame 18 supporting a drive mechanism 22 that can be axially translated 26 about the supporting frame 18 along rails 30. The axial translation 26 is actuated by an actuator 34, or a pair or actuators 34, as illustrated in FIG. 1. Interconnecting elements, like wires, hose and other elements are optionally housed in an articulated support 38 that can accommodate the translation 26 of the drive mechanism 22.

The drive mechanism 22 illustrated in FIG. 1 and FIG. 2 includes a support 42 slidably connected to the rails 30 at a first end 46 thereof. A spool-engaging member 50 is rotatably connected to the support 42 at a second end 54 thereof, along a rotation axis 58. The spool 14 is rotatably actuated by a spool actuator 62 interconnected with a drive member 66 and associated pulleys 70. Proper tension in the drive member 66 is provided by a tensioner 74 in the illustrated embodiment.

Figure 3:
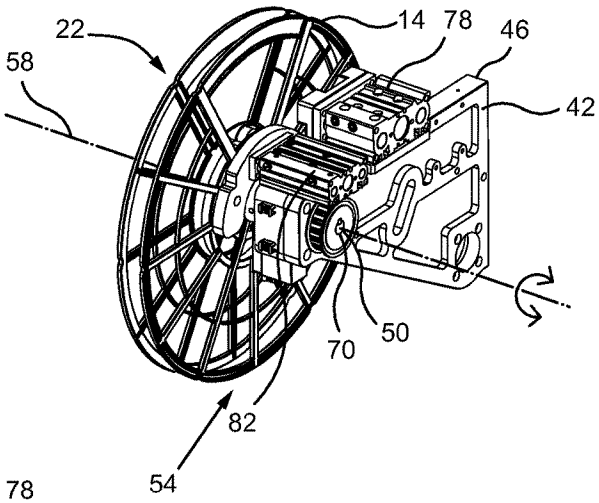
FIG. 3 is a perspective view of a drive mechanism in accordance with at least one embodiment of the invention.
Figure 4:
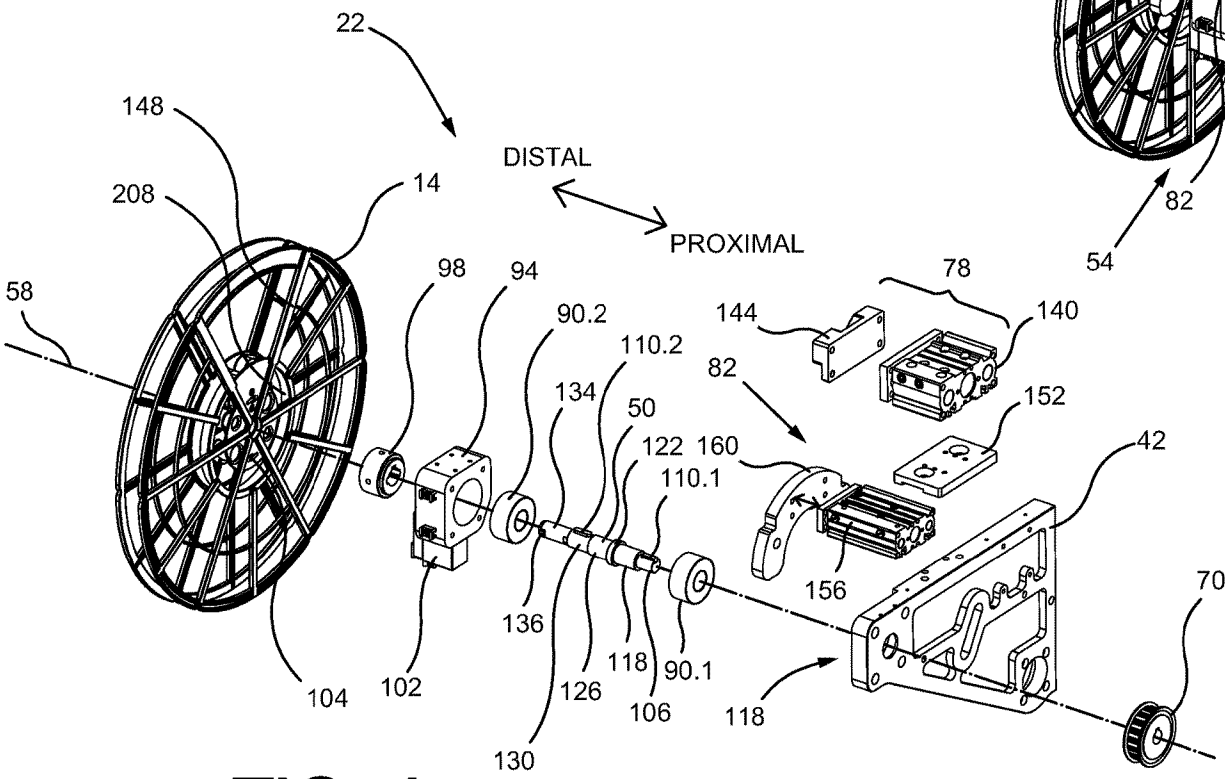
FIG. 4 is a perspective view of an exploded drive mechanism in accordance with at least one embodiment of the invention.

FIG. 3 depicts an embodiment of the drive mechanism 22 without its associated supporting frame 18. An exploded view of the drive mechanism 22 is illustrated in FIG. 4. It can be appreciated the spool-engaging member 50 is rotatably supported by the support 42 with bearing members 90 housed in a bearing holder 94 and supporting, at a distal end thereof, a spool-contacting member 98. It can also be appreciated the bearing holder 94 is associated with an RFID reader 102 adapted to take a reading of RFID chips 104 embedded in the spool 14. A suitable RFID, like the HF Circus R19 Wet Inlay, can be suitable for the present application. The RFID HF Circus round wet inlay has a 19 mm diameter and consists of 13.56 MHz high frequency (HF) transponders that are compliant with ISO 15693 and ISO 18000-3; a global open standard. This transponder inlay is well suited for small stickers, key tags, item-level applications and ticketing of spools. The following additional technical specifications: Memory: 1 k bits; Antenna Size: ø16 mm; Die Cut Size: ø19 mm; IC: NXP ICode SLIX.

The support 42 is also equipped with a spool-rotation blocking assembly 78 and a spool-pushing assembly 82. The spool-rotation blocking assembly 78 is selectively actuated to allow, when disengaged from the spool 14, rotation of the spool 14 and prevent, when engaged with the spool 14, rotation of the spool 14 on the spool-engaging member 50. The spool-engaging member 50 includes several axial sections. Beginning from a proximal side of the spool-engaging member 50, as identified in FIG. 4, a first section 106 is engaging a pulley 70 on a proximal side of the support 42 and is rotationally connected to the pulley 70 with a key lock 110, or another mechanism providing similar rotation blocking results about the spool-engaging member 50. A second section 114 is sized and design to received thereon a first bearing 90.1 adapted to be housed in a bearing-receiving housing 118 shaped in the support 42 and is followed with a shoulder 122 axially locking the spool-engaging member 50 in the support 42 with the pulley 70 assembly on the proximal side of the support 42. A third section 126 is sized and design to received thereon a second bearing 90.2 that is going to be axially secured on the distal side by the spool-contacting member 98 rotatably locked against the spool-engaging member 50 with a key lock 110, or the like, located at a fourth portion 130 of the spool-engaging member 50. A spool-engaging drive portion 134 is located at a distalmost end of the spool-engaging member 50 for engaging a corresponding central opening in the spool 14 and is followed by a locking member 136.

Still referring to FIG. 4, it is possible to appreciate the spool-rotation blocking assembly 78 includes an axial actuator 140 connected to a spool-blocking member 144 designed to engage branches 148 of the spool 14. The spool-rotation blocking assembly 78 is secured to the spool-pushing assembly 82 by an intervening connector 152. The spool-pushing assembly 82 comprises an axial actuator 156 connected to a spool-pushing member 160 to distally push out of the spool-engaging drive portion 134 when the spool 14 is empty.

The drive mechanism 22 can be used in conjunction with a balancing weights installation apparatus (not illustrated). The balancing weight installation apparatus is designed to manage the procurement of specific wheel-balancing weight masses that come in strips to be secured to a wheel and balance the wheel. In contrast, the drive mechanism 22 could be used to roll a strip of products at the end of a process. The drive mechanism 22 would rotate to collect and store in spools 14 goods/products after they are manufactured to storage and shipment.

Figures 5A, 5B, 5C, 5D:
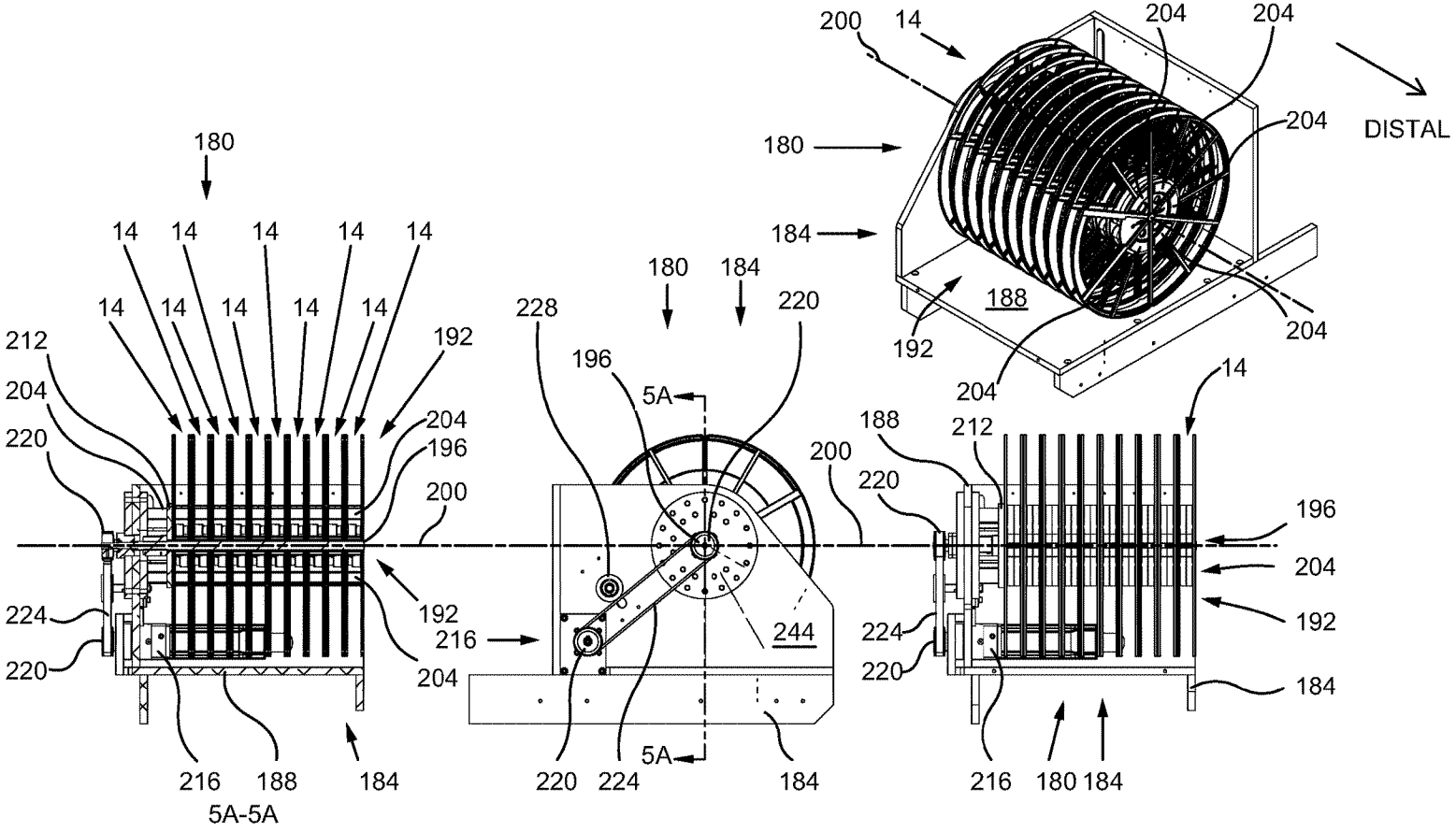
FIG. 5(A) is an elevation section view of a supplying module in accordance with at least one embodiment of the invention.
FIG. 5(B) is a side elevation view of a supplying module in accordance with at least one embodiment of the invention.
FIG. 5(C) is an elevation view of a supplying module in accordance with at least one embodiment of the invention.
FIG. 5(D) is an isometric view of a supplying module in accordance with at least one embodiment of the invention.

An exemplary supplying module 180, depicted in FIG. 5, is designed to provide a continuous strip of weights to the balancing weight application apparatus. The strip is generally a juxtaposed series of weights secured to each other with a tape to continuously supply a desired number of weights to the balancing weight application apparatus. Each weight, generally made of a heavy material like steel, lead or tungsten, is generally distinct from the other adjacent weights hence allowing some movement therebetween. The length, height and width of a weight are preferably standardized for ease of packaging and management predictability. However, the balancing weight application apparatus can manage weights of different proportions that can be better adapted for particular applications. The strip allows long productivity cycles without having to reload the supplying module 180 with an additional strip of weights. Other alternate weights-supplying configurations that could be used with the balancing weight application apparatus and remain within the scope of the present application despite the illustrated embodiments are limited to some possible configurations for illustrative purposes.

The supplying module 180 provides strips of weights that are winded on spools 14 for compact shipment and easy manipulation. Spools 14 can be housed and managed in a spool manager assembly 184 to further facilitate management thereof. The spool manager assembly 184 can support a plurality of spools 14 and provide a spool 14 to the cooperating spool-supporting assembly 10 that would allow controlled unwinding of the strip. Each spool 14 of weights can be operatively installed in the drive mechanism 22 in a manner suitable to provide weights to a feeding module, for instance.

The exemplified spool manager assembly 184 of FIG. 5 includes a frame 188 forming a structure adapted to sequentially mount a plurality of spools 14 in a spools receptacle 192. The exemplified spools manager assembly 184 is including a spool-supporting axle 196 adapted to receive thereon and support a plurality of individual spools 14 along an axle axis 200. Each spool 14 in the illustrated configuration is containing, for example, a strip of weights of about 9 kg (about 20 pounds) each. As mentioned above, each individual spool 14 can accommodate weights of different configurations, sizes, finishes, colors or masses to provide a plurality of different weights or all the same masses model in order to feed a spool 14 full of weights to the spool-supporting apparatus 10 when the spool 14 on the spool-supporting apparatus 10 is empty. The spool-supporting axle 196 is secured to the frame 188, in cantilever, thus allowing axial insertion and removal of spools 14. The illustrated spools manager assembly 184 can accommodate ten (10) spools 14 although a different number of spools 14 could be used. The spools 14 stored in the spools receptacle 192 are rotatably restricted about the spool axle axis 200 by one or a plurality of spool angular locating members 204 axially projecting from the side of the frame 188 holding the spool-supporting axle 196. The spool angular locating members 204 are engaging openings 208 in each spool 14 to prevent undesired rotation of the spools 14. Indeed, the spools 14 could have a tendency to unwind given the significant mass of the strip of weights enclosed therein. The openings 208 pattern is designed such that the spools 14 are all located in a single possible angular position to ensure the end of the strip is going to be located at the same position for each of the spools 14. The spool angular locating members 204 have preferably an axial length similar to the length of the spool-supporting axle 196 to axially rotatably secure all the spools 14 on the spool-supporting axle 196.

The spool manager assembly 184 further includes a push member 212 adapted to axially push the spools 14 toward the distal end of the spool-supporting axle 196, or out of the spool-supporting axle 196. The push member 212 is embodied as a circular plate movable along the spool-supporting axle 196. Axial movement of the push member 212 in the illustrated configuration is actuated by a servo motor 216 (other alternative means for knowing the angular and/or linear position of the push member 212 are contemplated in the present application) operatively connected to the push member 212 with a pair of pulleys 220 and a belt 224 tensed with an optional tensioner 228. The servo motor 216 can selectively move the push member 212 in both axial directions and can configured to move by increments of one or more spool 14 thickness. The embodied mechanism axially moves the push member 212 without rotating it about the spool-supporting axle 196.

The spools receptacle 192 of the spools manager assembly 184 is used in cooperation with the spool-supporting assembly 10. A spool-free spool-supporting assembly 10 can load a spool 14 from the spools receptacle 192, as it can be appreciated in FIG. 6, when a spool 14 is in the spool-loading position 232. The spool is moved on the spool-engaging member 50, manually or automatically by actuation of the push member 212. The drive mechanism 22 of the spool-supporting assembly 10 then moves to a feeding position 236 to feed the strip for assembling the weights to the wheel or for other parts dispensing capability in a production process. The drive mechanism 22 moves to an unloading position 240 when the spool 14 is empty of strip to unload the empty spool 14 with an actuation of the spool-pushing assembly 82. The empty spool then falls in an empty spool receptacle (not illustrated). The push member 212 is used in cooperation with the axially positioned spool-supporting assembly 10 abutting the spool-supporting axle 196 to push a spool 14 toward the spool-supporting assembly 10 that is axially engaging and securing the spool 14 thereon. The axially mounted spool 14 is then moved to the feeding position 236 for feeding the strip of weights to the balancing weight application apparatus (not illustrated). The spool 14 and the spool-engaging member 50 rotate to let fall the end of the strip on a strip receiver 244, located in a strip-reception position 248, to route the strip of weights toward their installation on wheels.

Figure 6A:
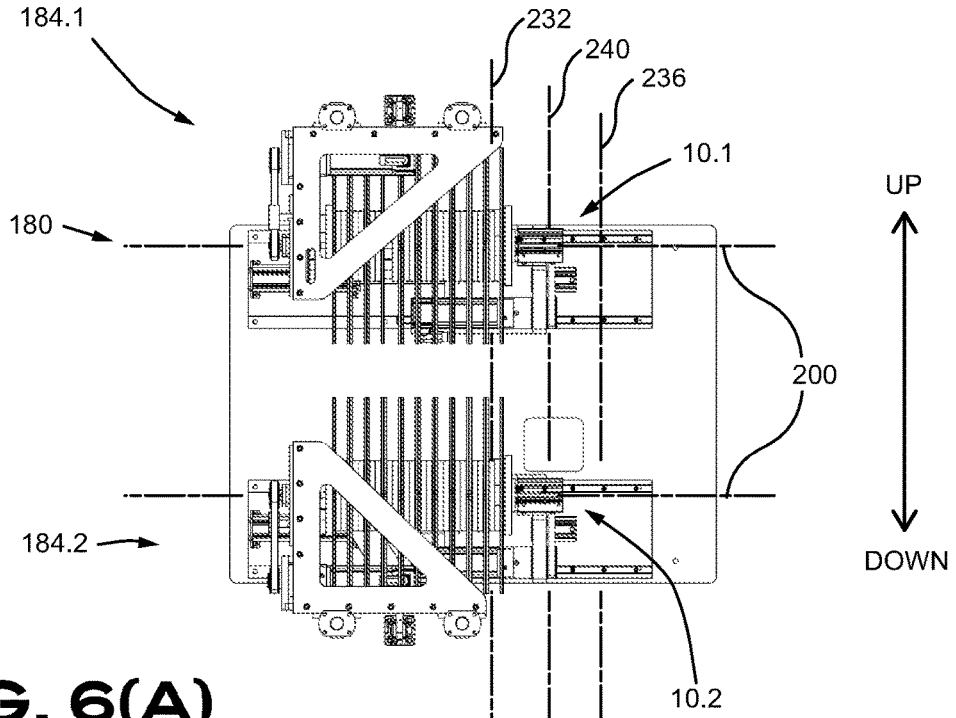
FIG. 6(A) is an elevation view of a pair of supplying modules in accordance with at least one embodiment of the invention.
Figure 6B:
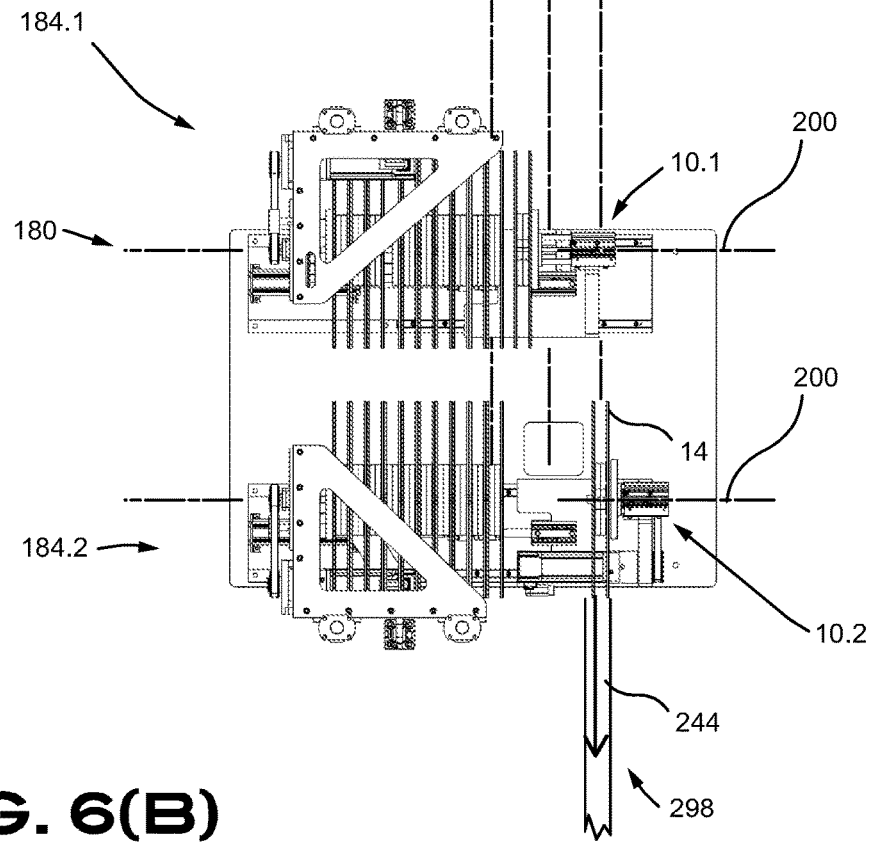
FIG. 6(B) is an elevation view of a pair of supplying modules in accordance with at least one embodiment of the invention.

The supplying module 180 illustrated in FIG. 6 is embodied with a plurality of spools manager assemblies 184.1 and 184.2. The plurality of spools manager assemblies 184.1 and 184.2 provides a choice of weights having different characteristics to the balancing weight application apparatus. For instance, a first spools manager assembly 184.1 could provide grey colored weights to match grey colored or greyish wheels and alternatively provide with the second spools manager assembly 184.2 weights having different characteristic, like black colored weights to match black or dark wheels as identified by sensors of the balancing weight application apparatus. Still referring to FIG. 6, the spools manager assembly 184.1 and its counterpart spool-supporting assembly 10.1 are in the loading position 232 where a spool 14 is mounted on the spool-supporting assembly 10.1. As best seen in FIG. 6 B), the spool-supporting assembly 10.1 is slightly moved away from the spools manager assembly 184.1 toward the feeding position 236 illustrated with the position of the lower spool-supporting assembly 10.2.

Figures 7, 8, 9, 10, 11, 12, 13:
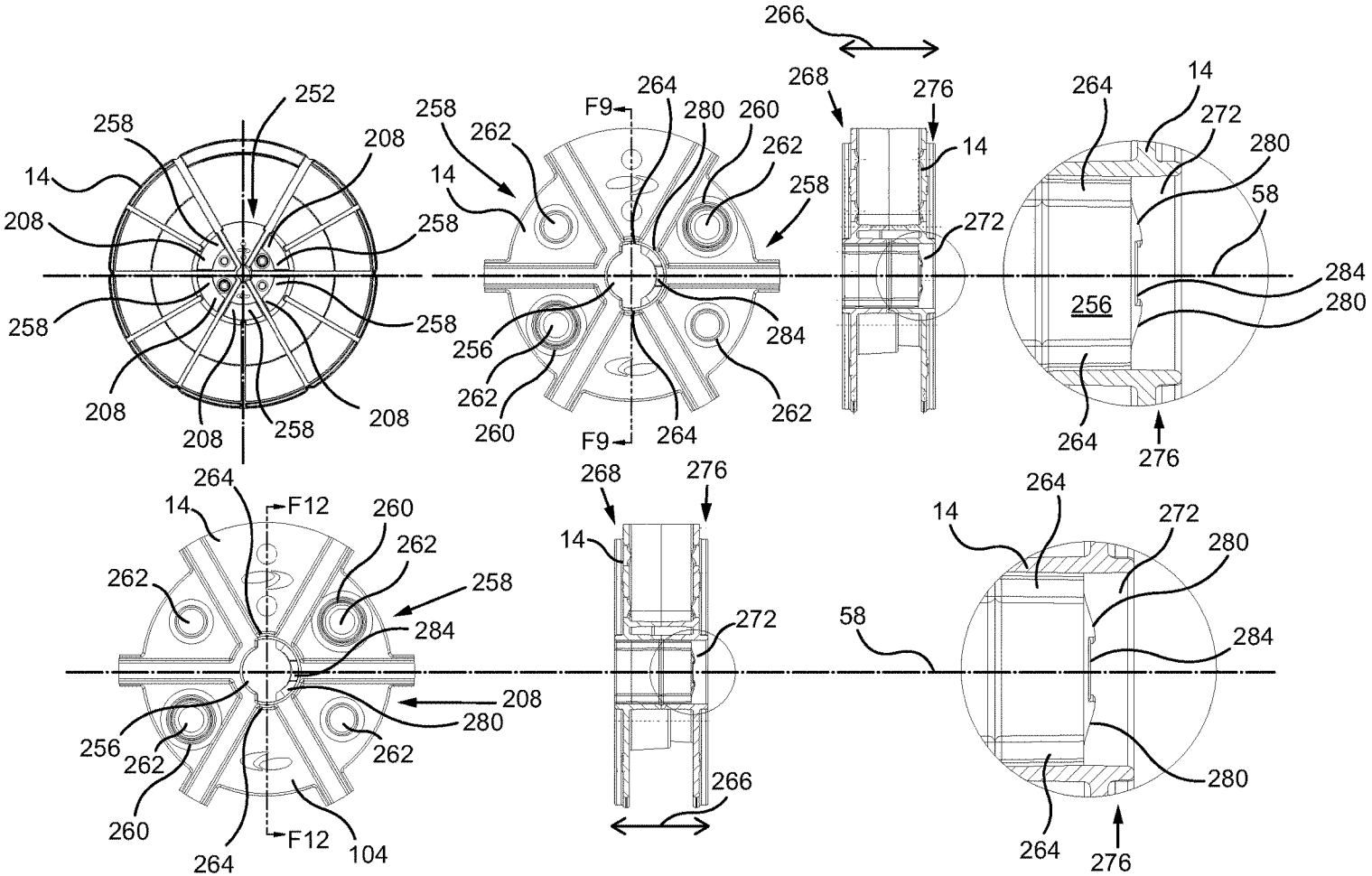
FIG. 7 is an axial elevation view of a spool in accordance with at least one embodiment of the invention.
FIG. 8 is a partial axial elevation view of a spool in accordance with at least one embodiment of the invention.
FIG. 9 is a partial section view of a spool in accordance with at least one embodiment of the invention.
FIG. 10 is a partial magnified section view of a spool in accordance with at least one embodiment of the invention.
FIG. 11 is a partial axial elevation view of a spool in accordance with at least one embodiment of the invention.
FIG. 12 is a partial section view of a spool in accordance with at least one embodiment of the invention.
FIG. 13 is a partial magnified section view of a spool in accordance with at least one embodiment of the invention.

Referring now to FIG. 7 throughout FIG. 13. The spool 14 includes a central portion 252 including a central opening 256 and a plurality of assembly openings 260 and at least one angular locating member receiver 258 radially disposed about the rotation axis 58. The angular locating member receiver 258 are sized and designed to receive therein the spool angular locating member 204. The central opening 256 is sized and designed to receive therein the spool-engaging member 50. The assembly openings 260 are located, sized and designed to receive therein a connector 262 for securing both halves of the spool 14. The assembly openings 260 and corresponding connectors 262 are alternated on a proximal side 268 and a distal side 276 of the spool 14. The assembly openings 260 and corresponding connectors 262, embodied as a hole 260 and as a connector 262 with a conical shape interacting with the hole 260, are engaging together to secure the proximal side 268 and the distal side 276 of the spool 14. This assembly between the proximal side 268 and the distal side 276 is allowing some axial compression that is used to allow engagement of the locking member 136 with the locking member receiver 284, particularly when the spool 14 has no ramps 280. Expansion of the proximal side 268 and the distal side 276, returning from compression, is keeping the locking member 136 secured in the locking member receiver 284. It can be appreciated that the locking member 136 can be made, or covered, with low friction material such as Teflon™. The central opening 256 includes at least one slot 264, however two opposed slots 264 are illustrated in the present embodiment, to receive the locking member 136 of the spool-supporting axle 196. For illustrative purposes, the width of the slot 264 can be embodied as being about between 5 mm and 8 mm wide, and more preferably about 6.5 mm (0.256") wide while the central opening can be embodied as being between about 15 mm and 18 mm in diameter, and more preferably about 16.8 mm (0.661") in diameter. It can be appreciated that an adaptor (not illustrated) used to provide similar dimensions to mate with the spool-engaging member 50 for supporting a spool 14 having a different center configuration is within the scope of the present specification. Put differently, a spool 14 with a different center configuration that can be used in combination with an adaptor including a center configuration adapted to be operatively connected with the spool-engaging member 50 for supporting a spool 14 is an equivalent of the spool 14 exemplified in this specification. The spool 14 can be embodied with an axial thickness 266 of about 32 mm (1.250"). The spool 14 surface of the illustrated embodiment ends flush with a proximal side 268 of the spool 14 while the recessed portion 272 is located on the distal side 276. The recessed portion 272 is sufficiently deep for accommodating a thickness of the locking member 136 for rotating the locking member 136, once the locking member 136 is passed through the central opening 256, without interfering with an adjacent spool 14 when a spool 14 is transferred to the drive mechanism 22 from the supplying module 180. The recessed portion 272 of the present embodiment is about 5 mm (0.20") deep (in the axial direction). The recessed portion 272 further accommodates a locking member receiver 284 sized and designed to received therein the locking member 136 when the locking member 136 is rotated and moved along adjacent ramps 280. The optional ramps 280 route the locking member 136 to the recessed portion 272 that is capturing the locking member 136 therein. The interaction of the locking member 136 with the spool 14 is going to be discussed in more details below.

Figures 14, 15:
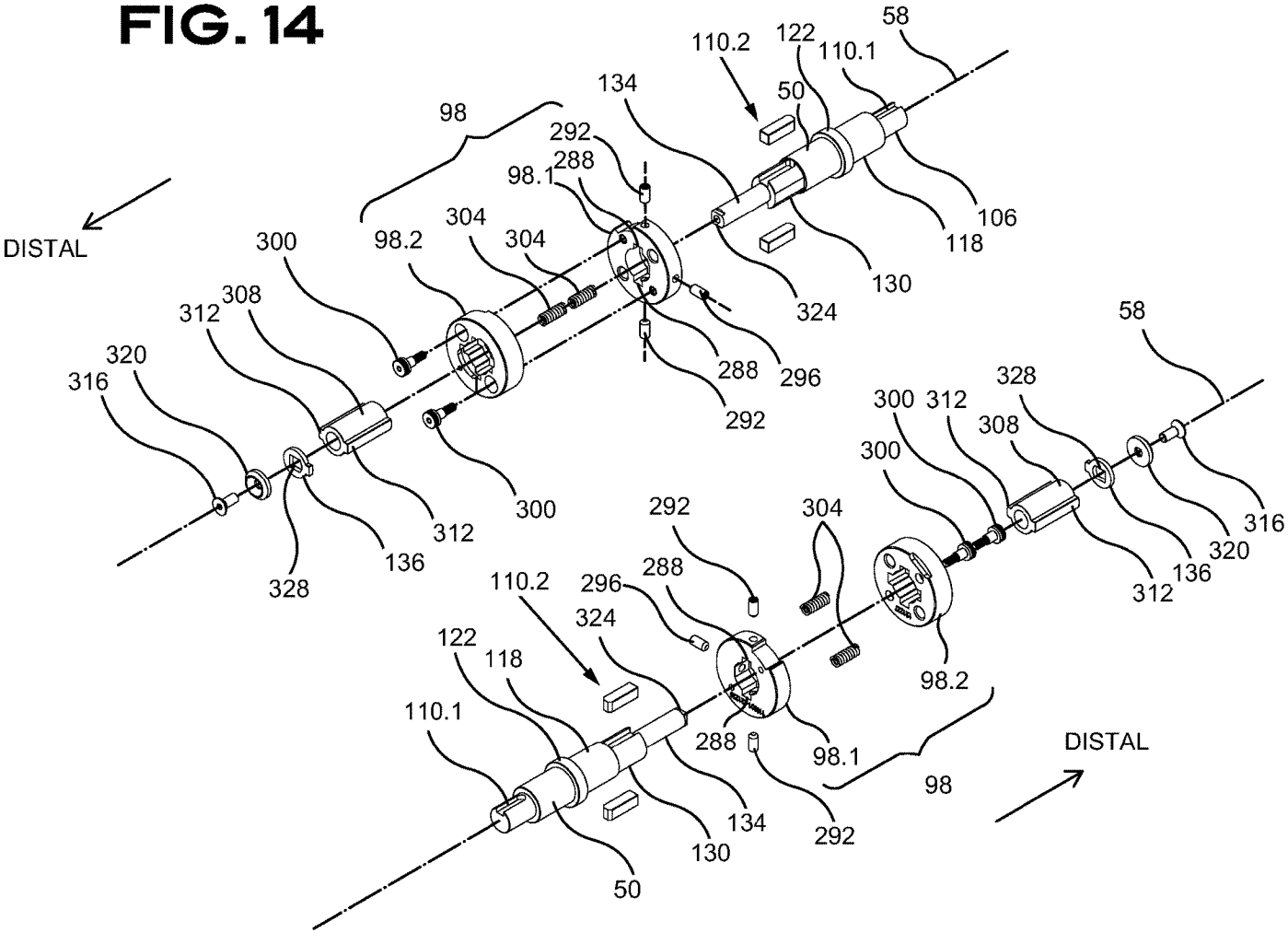
FIG. 14 is an isometric exploded view of a spool-engaging member assembly in accordance with at least one embodiment of the invention.
FIG. 15 is an isometric exploded view of a spool-engaging member assembly in accordance with at least one embodiment of the invention.

FIG. 14 and FIG. 15 are illustrating an exploded view of the spool-engaging member 50 discussed in respect with FIG. 4 above. The key lock 110.2 are rotatably securing a fixed portion 98.1 of the spool-contacting member 98 with corresponding female key receivers 288 and held with set screws 292. An additional set screw 296 axially locks the fixed portion 98.1 of the spool-contacting member 98 to the spool-engaging member 50. A mobile portion 98.2 of the spool-contacting member 98 is axially secured to the fixed portion 98.1 of the spool-contacting member 98 with a pair of shoulder bolts 300 with a pair of intervening springs 304 distally biasing the mobile portion 98.2 of the spool-contacting member 98. A torque member 308 including a pair of radially protruding slot-engaging members 312 is rotatably assembled on the spool-engaging drive portion 134. The torque member 308 can be embodied as being about 16.3 mm (0.640") in diameter and the slot-engaging members 312 can be embodied as being about 6.1 mm (0.240") wide. The pair of radially protruding slot-engaging members 312 is extending over the width of the spool 14 to reduce the stress on the slots 264 of the spool 14 and prevent stripping of the slots 264 material given the significant torque applicable to the spool 14 with rotating spool 14 that is full of weights.

The pair of radially protruding slot-engaging members 312 is also adapted to engage a central portion of the mobile portion 98.2 of the spool-contacting member 98 to selectively allow a 90-degree rotation about the mobile portion 98.2 of the spool-contacting member 98. A bolt 316 and washer 320 are axially securing the torque member 308 to the spool-engaging member 50. One can also appreciate the distal end of the spool-engaging member 50 includes an interlocking shape 324 configured to prevent rotation of the locking member 136 with engagement of a corresponding shape 328 therein.

A spool 14 can be mounted on the spool-engaging member 50 of the drive mechanism 22 manually or automatically. The following is going to describe interactions between a spool 14 and the spool-engaging member 50. The spool 14 can be manually or automatically secured to the spool-engaging member 50. Manually pivoting the spool 14 on the spool-engaging member 50 is going so secured the spool 14 on the spool-engaging member 50. Automatic securing of the spool 14 can be achieved using a rotation of the drive mechanism 22 to engage the locking member 136 with the spool 14. As mentioned above, a spool 14 is moved to the distal end of the spool-supporting axle 196 of a spools manager assembly 184. The drive mechanism 22 is also moved to abut the spool-engaging member 50 to the distal end of the spool-supporting axle 196. The spool 14 at the distal end of the spool-supporting axle 196 is manually pushed on the spool-engaging member 50. The spool 14 is then locked on the spool-engaging member 50 with a partial rotation of the spool 14 on the spool-engaging member 50. A plurality of stages is required to secure the spool 14 on the spool-engaging member 50; these stages are illustrated in FIG. 16 throughout FIG. 20.

Figures 16, 17, 18, 19, 20, 21, 22, 23:
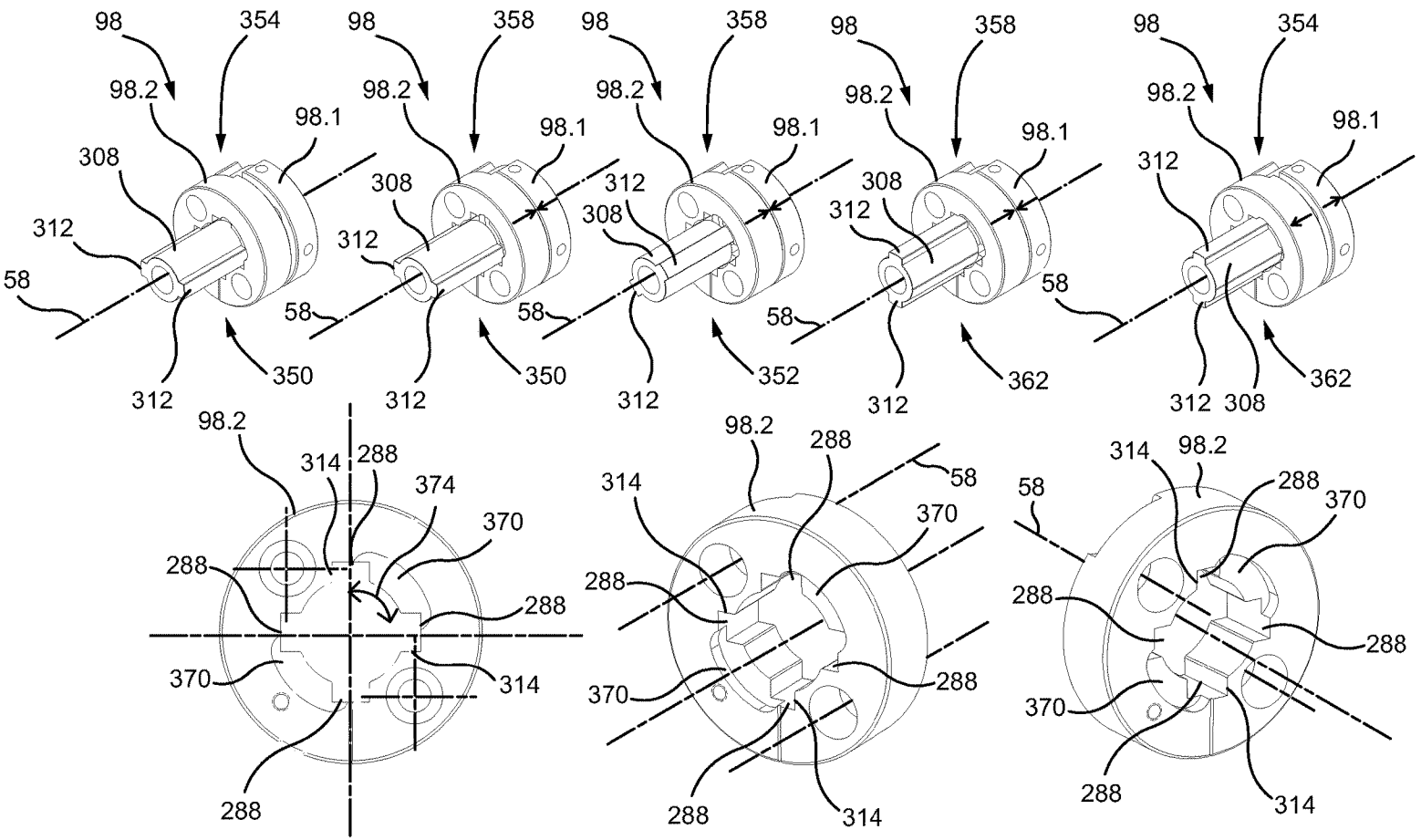
FIG. 16 is an isometric exploded view of a portion of the spool-engaging member assembly, in arrangement 1, in accordance with at least one embodiment of the invention.
FIG. 17 is an isometric exploded view of a portion of the spool-engaging member assembly, in arrangement 2, in accordance with at least one embodiment of the invention.
FIG. 18 is an isometric exploded view of a portion of the spool-engaging member assembly, in arrangement 3, in accordance with at least one embodiment of the invention.
FIG. 19 is an isometric exploded view of a portion of the spool-engaging member assembly, in arrangement 4, in accordance with at least one embodiment of the invention.
FIG. 20 is an isometric exploded view of a portion of the spool-engaging member assembly, in arrangement 5, in accordance with at least one embodiment of the invention.
FIG. 21 is an elevation view of the moving portion of the spool-contacting member in accordance with at least one embodiment of the invention.
FIG. 22 is an isometric view of the moving portion of the spool-contacting member in accordance with at least one embodiment of the invention.
FIG. 23 is an isometric view of the moving portion of the spool-contacting member in accordance with at least one embodiment of the invention.

FIG. 16 depicts a first arrangement where the torque member 308 and spool-contacting member 98 assembly with the torque member 308 in a spool-insertion configuration 350 and the mobile portion 98.2 in a locked position 354. FIG. 17 depicts a second arrangement where the torque member 308 and spool-contacting member 98 assembly with the torque member 308 in the spool-insertion configuration 350 and the mobile portion 98.2 in an unlocked position 358. FIG. 18 depicts a third arrangement where the torque member 308 and spool-contacting member 98 assembly with the torque member 308 in an intermediate configuration 352, between the spool-insertion configuration 350 and a spool-locking configuration 362, and the mobile portion 98.2 in the unlocked position 358. FIG. 19 depicts a fourth arrangement where the torque member 308 and spool-contacting member 98 assembly with the torque member 308 in the spool-locking configuration 362 and the mobile portion 98.2 in the unlocked position 358. FIG. 20 depicts a fifth arrangement where the torque member 308 and spool-contacting member 98 assembly with the torque member 308 in the spool-locking configuration 362 and the mobile portion 98.2 in the locked position 354.

TABLE 1

| Arrangement | Configuration | Position | FIG. | | |
|---|---|---|---|---|---|
| 1 | spool-insertion | locked | 16 | 24 | 29 |
| 2 | spool-insertion | unlocked | 17 | 25 | 29 |
| 3 | spool-insertion | unlocked | 18 | 26 | — |
| 4 | spool-locking | unlocked | 19 | 27 | 30 |
| 5 | spool-locking | locked | 20 | 28 | 30 |

It can be appreciated from FIG. 16 throughout FIG. 20 the mobile portion 98.2 is biased toward the fixed portion 98.1 by springs 304 and can be compressed toward the fixed portion 98.1 when the spool 14 is pressed toward the mobile portion 98.2. The compression of the mobile portion 98.2 is partially disengaging the pair of slot-engaging members 312 from the female key receiver 288 of the mobile portion 98.2. As best seen in FIG. 21, FIG. 22 and FIG. 23, the mobile portion 98.2 includes two recessed portions 370 located between two adjacent female key receivers 288. The recessed portions 370 include an axial depth allowing a partial axial disengagement of the slot-engaging members 312 from respective female key receivers 288 that is allowing a 90-degree pivot 374 about the rotation axis 58. The 90-degree pivot 374 of the slot-engaging members 312 of the torque member 308 that is adapted to move between the spool-insertion configuration 350 and the spool-locking configuration 362. Pivotal of the torque member 308 is limited to a 90-degree pivot 374 because the pair of slot-engaging members 312 are still angularly abutting a stopper side 314 of the female key receivers 288 when the mobile portion 98.2 is in the unlocked position 358.

One of the slot-engaging members 312 is axially aligned with the locking member 136 in the spool-insertion configuration 350. Conversely, the slot-engaging members 312 is not axially aligned with the locking member 136 in the spool-locking configuration 362. The locking member 136 is captured in the locking member receiver 284 with the axial pressure exercised by the mobile portion 98.2 on the spool 14 in the spool-locking configuration 362 and that the mobile portion 98.2 needs to be compressed toward the spool-insertion configuration 350. It can also be appreciated the shape of the ramps 280 is allowing compression of the mobile portion 98.2 toward the unlocked position 358 to engage the locking member 136 in the locking member receiver 284 with a pivotal of the spool 14.

Figure 24:
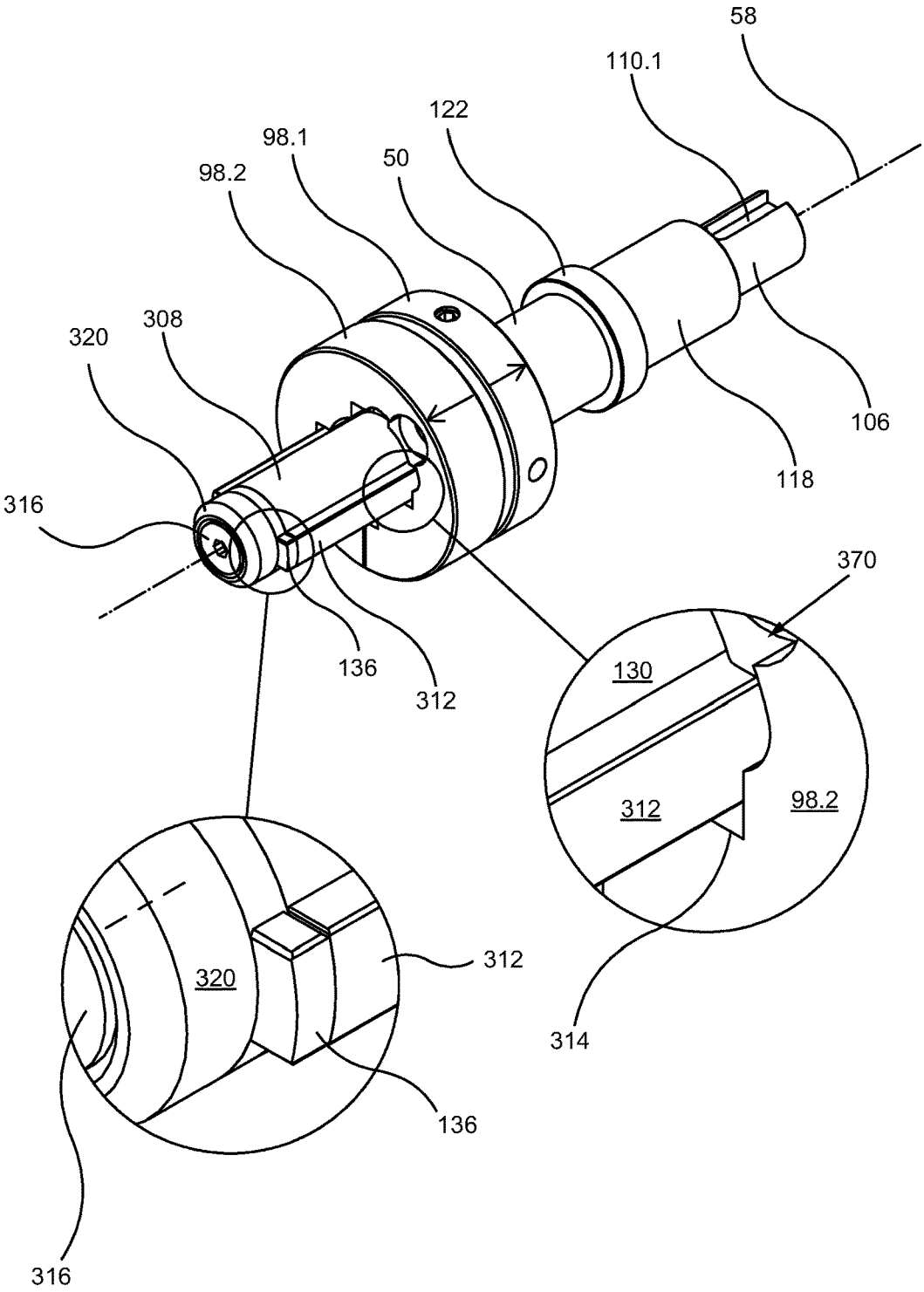
FIG. 24 is an isometric view of a portion of the spool-engaging member assembly, in arrangement 1, in accordance with at least one embodiment of the invention.
Figure 25:
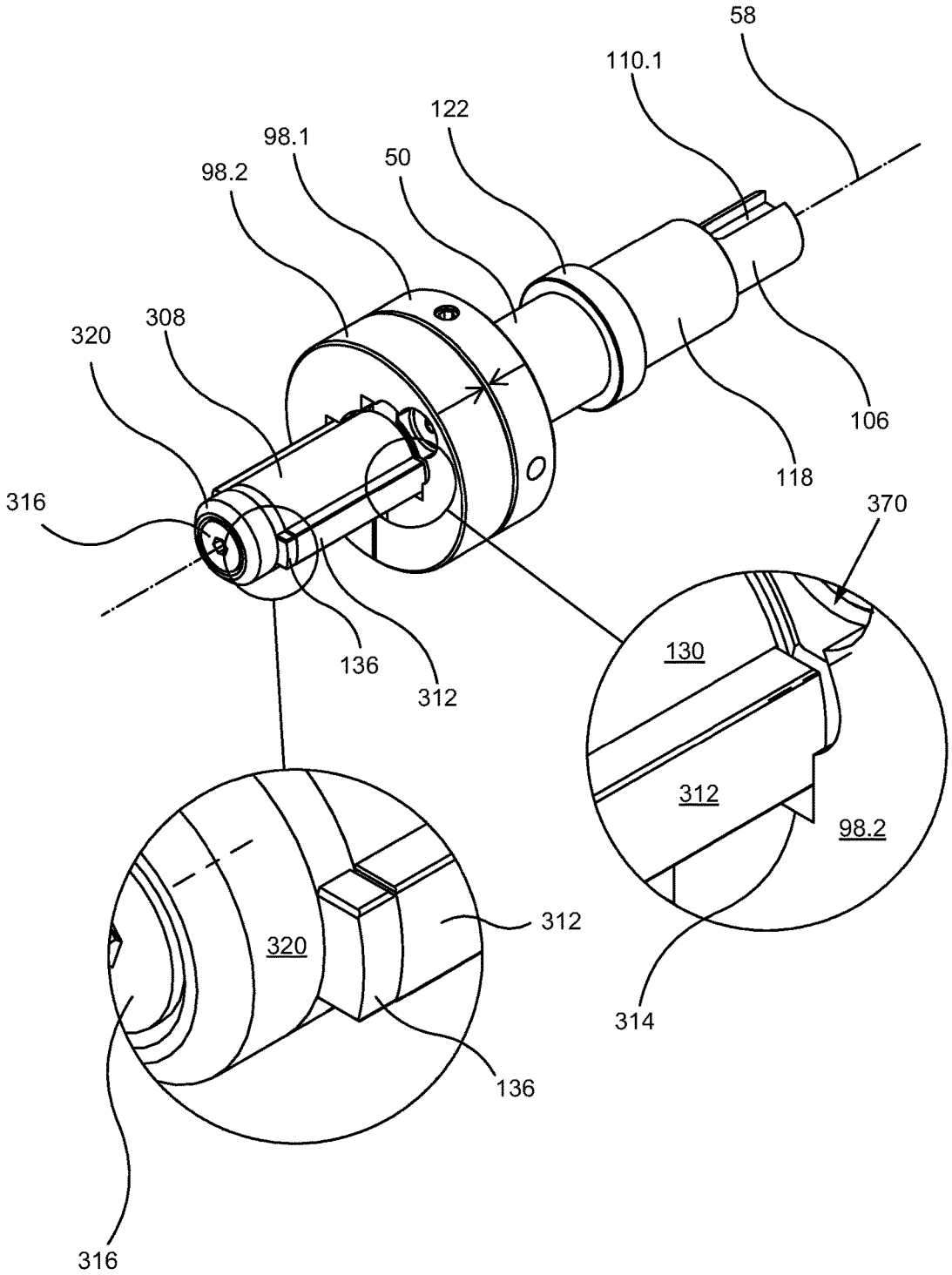
FIG. 25 is an isometric view of a portion of the spool-engaging member assembly, in arrangement 2, in accordance with at least one embodiment of the invention.
Figure 26:
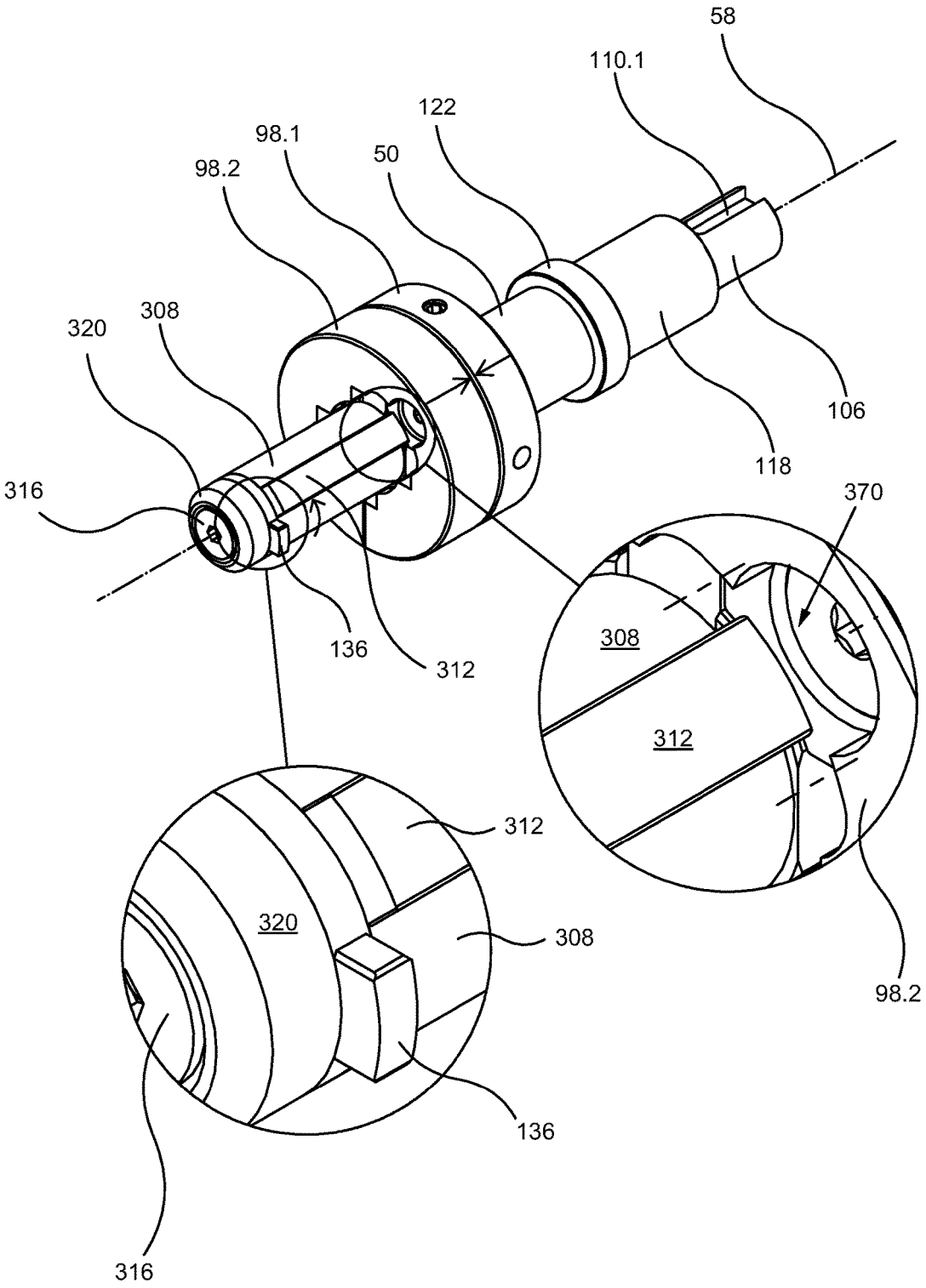
FIG. 26 is an isometric view of a portion of the spool-engaging member assembly, in arrangement 3, in accordance with at least one embodiment of the invention.
Figure 27:
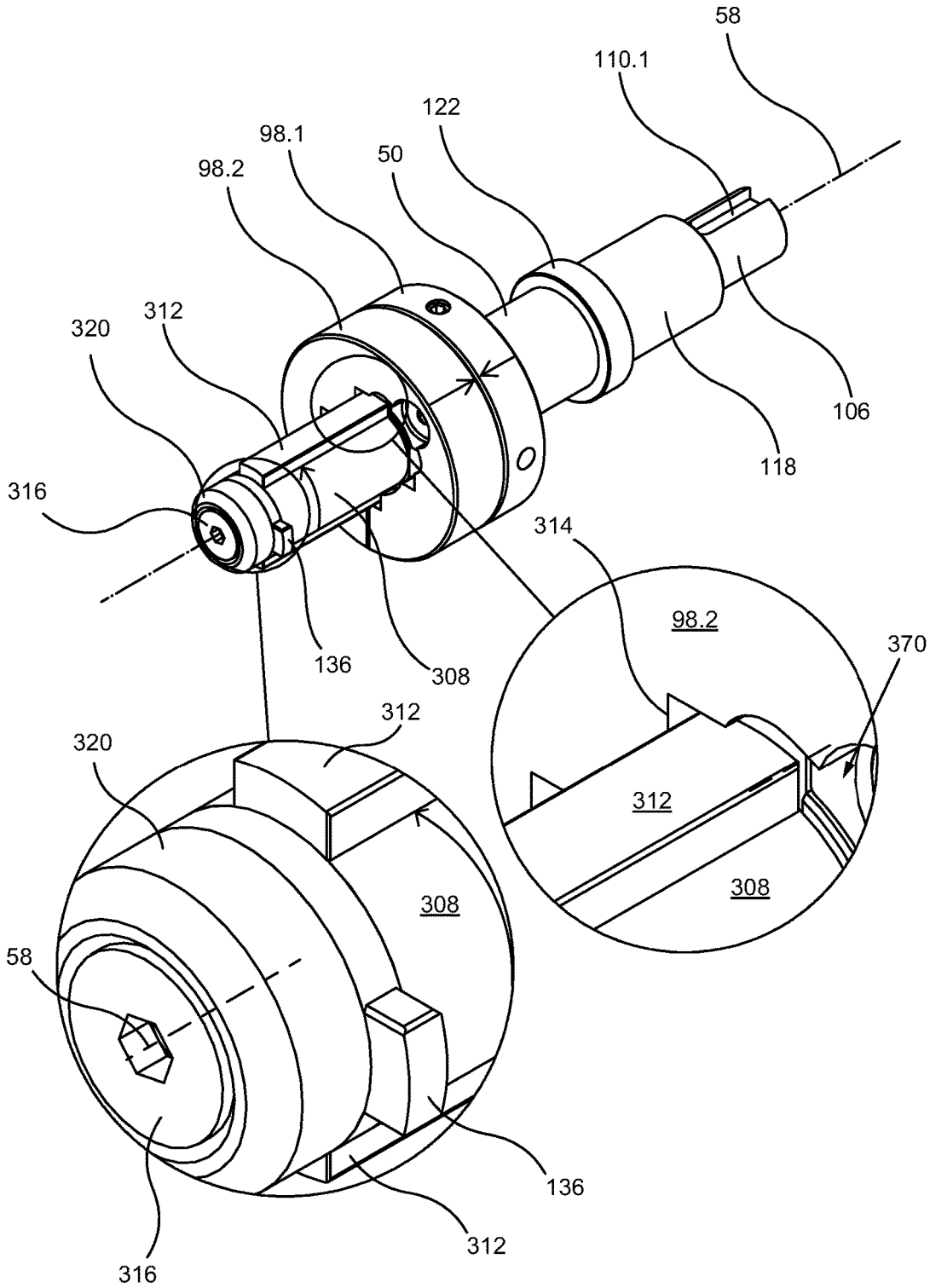
FIG. 27 is an isometric view of a portion of the spool-engaging member assembly, in arrangement 4, in accordance with at least one embodiment of the invention.
Figure 28:
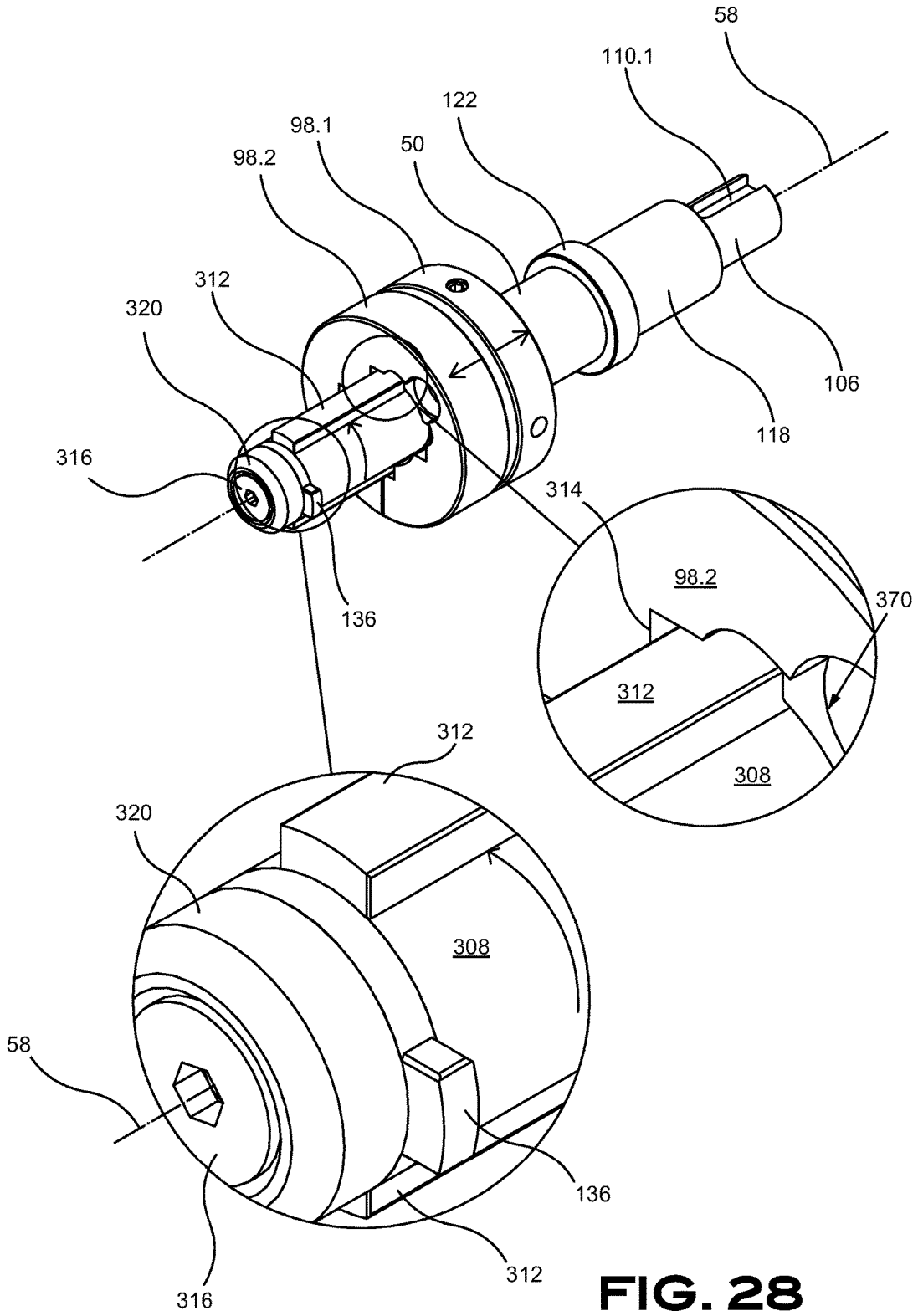
FIG. 28 is an isometric view of a portion of the spool-engaging member assembly, in arrangement 5, in accordance with at least one embodiment of the invention.
Figure 29:
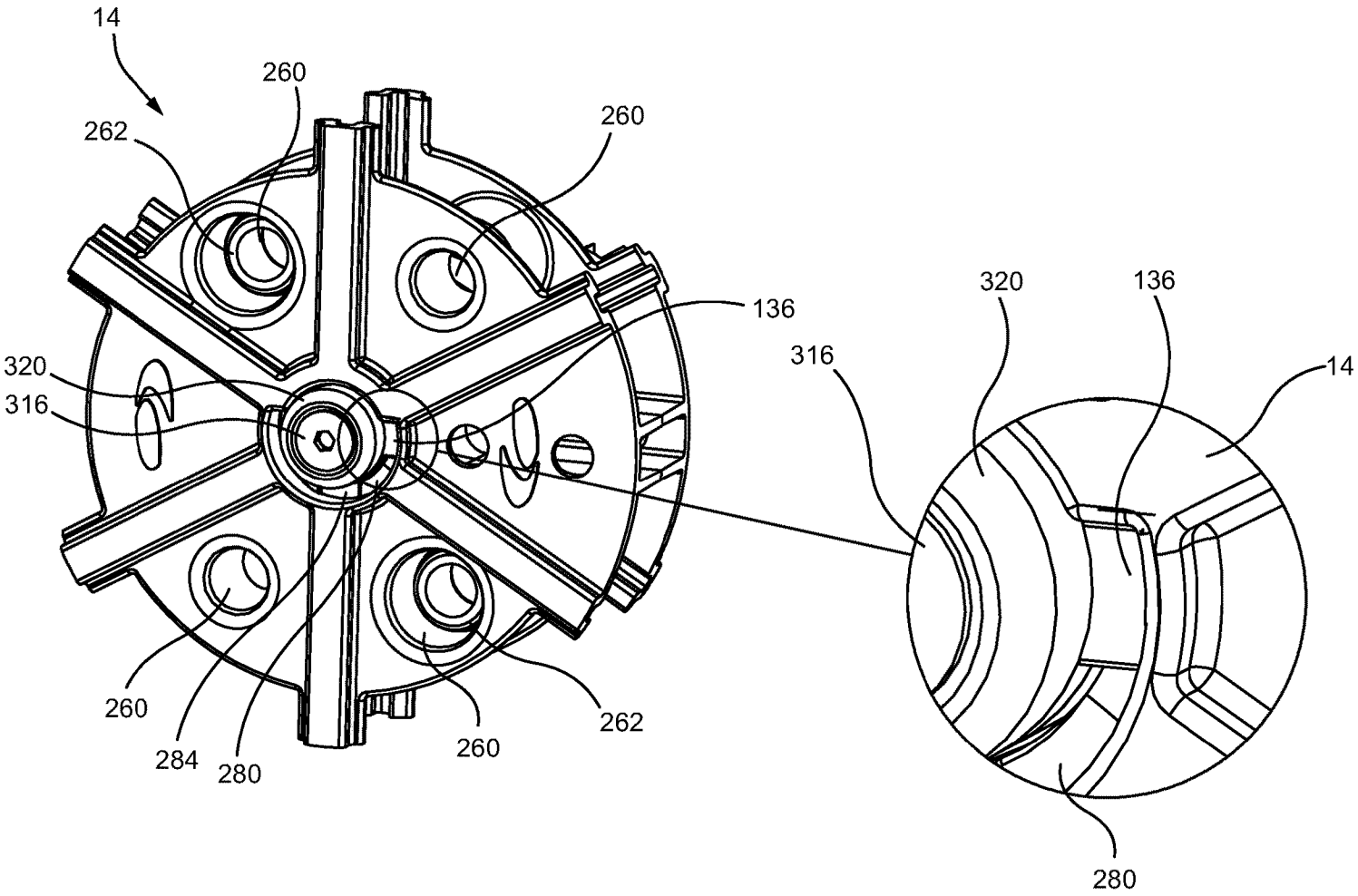
FIG. 29 is an isometric view of a portion of the spool on the spool-engaging member, in accordance with at least one embodiment of the invention.
Figure 30:
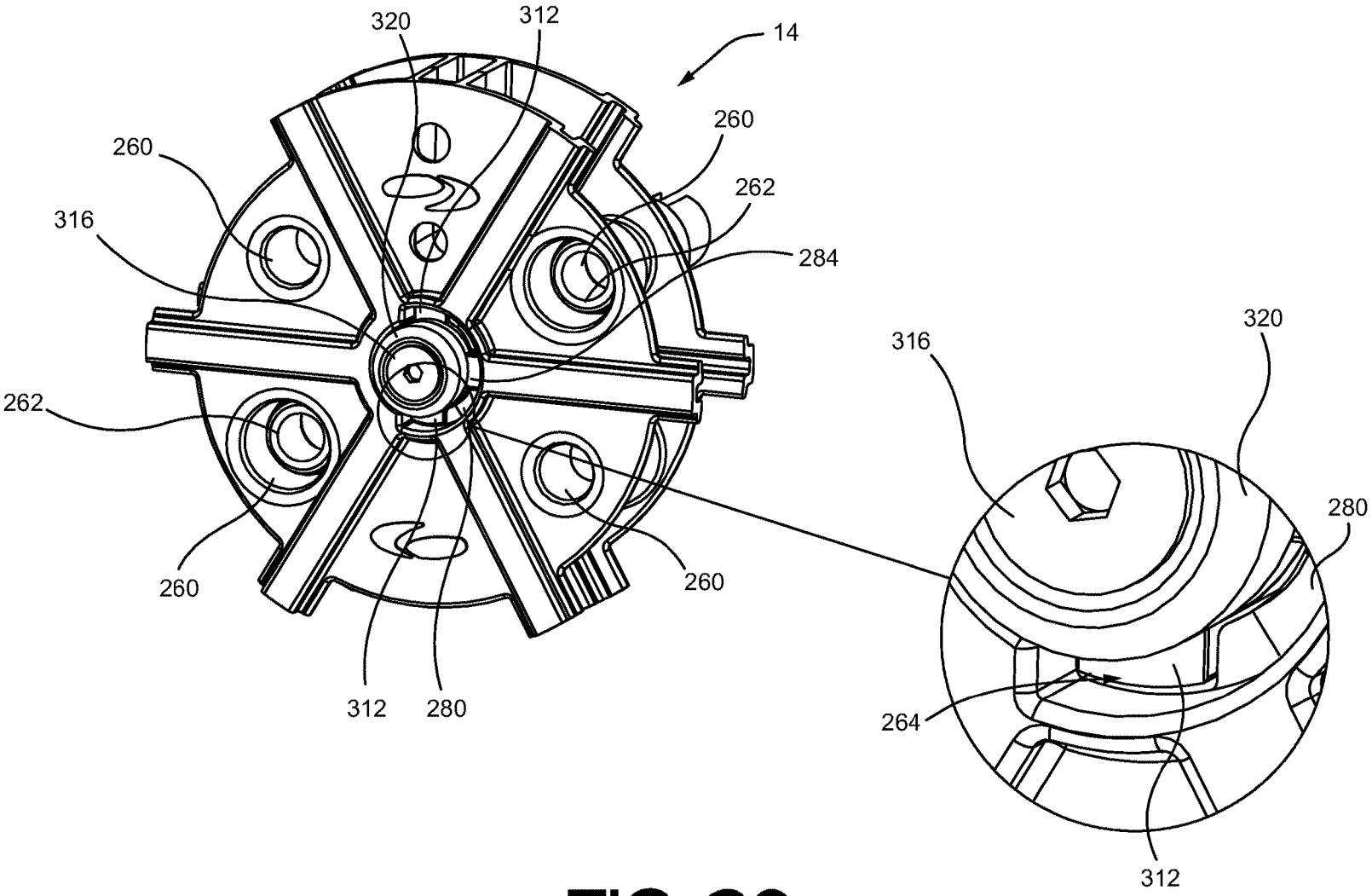
FIG. 30 is an isometric view of a portion of the spool on the spool-engaging member, in accordance with at least one embodiment of the invention.

FIG. 24 throughout FIG. 28 are illustrating the five arrangements listed in Table 1 above in further details. FIG. 29 depicts the relation with a spool 14 in regard with the first three arrangements in the spool-insertion position. Finally, FIG. 30 provides details of the spool 14 in interaction with the locking member 136 in the last three arrangements of Table 1.

Figure 32:
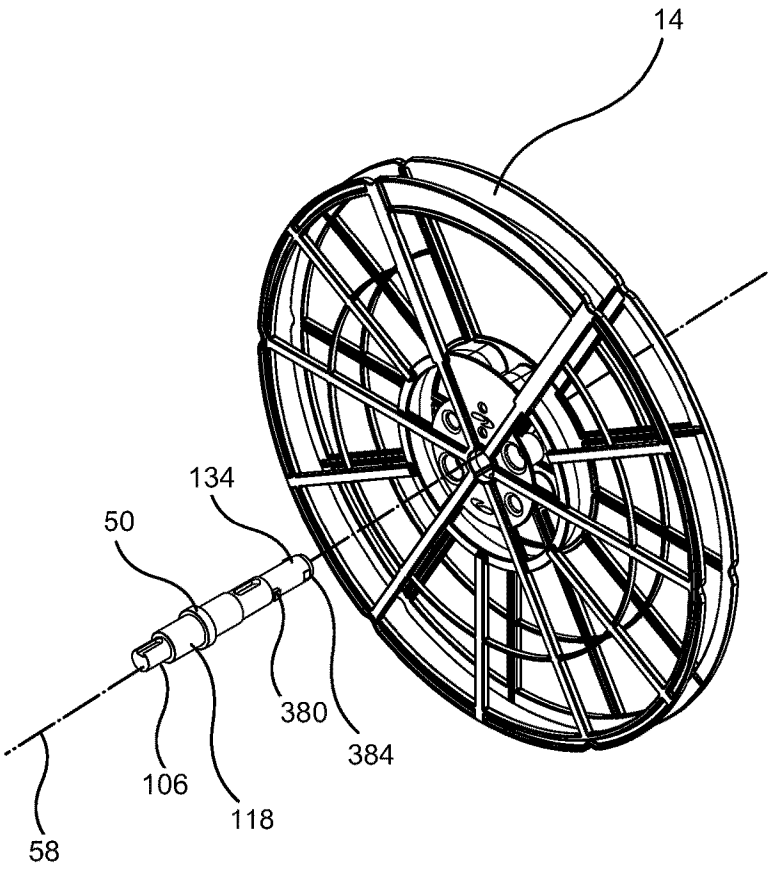
FIG. 32 is an isometric view of the spool and the spool-engaging member, in accordance with at least one embodiment of the invention.
Figure 31:
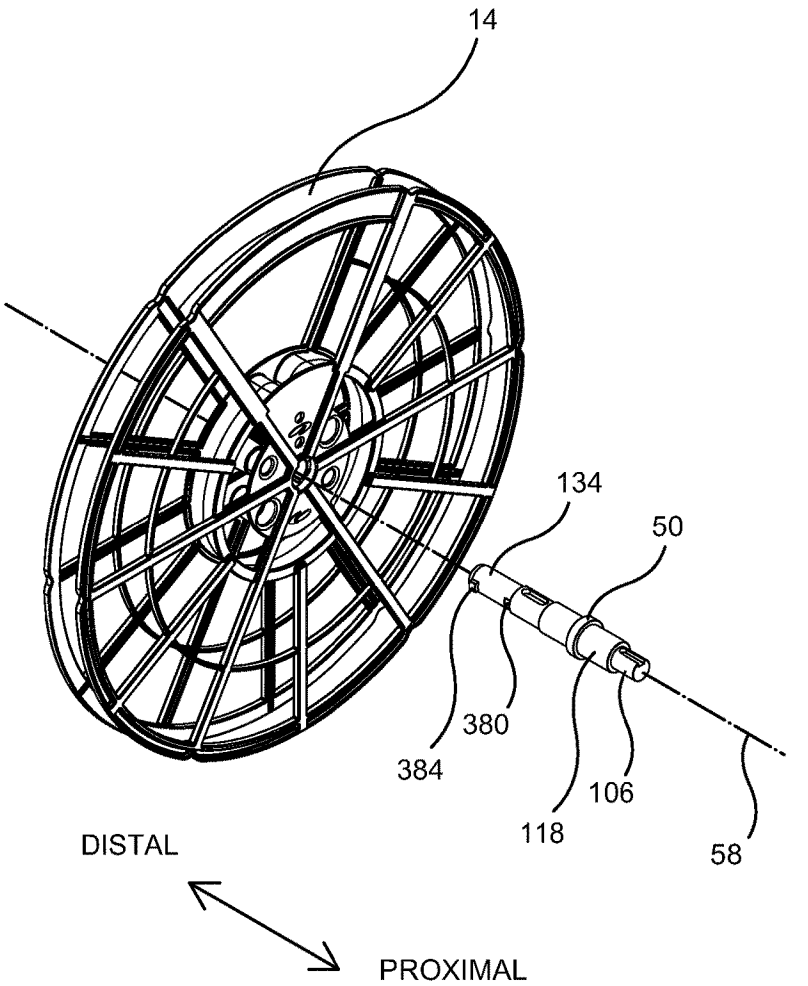
FIG. 31 is an isometric view of the spool and the spool-engaging member, in accordance with at least one embodiment of the invention.
Figures 33, 34, 35:
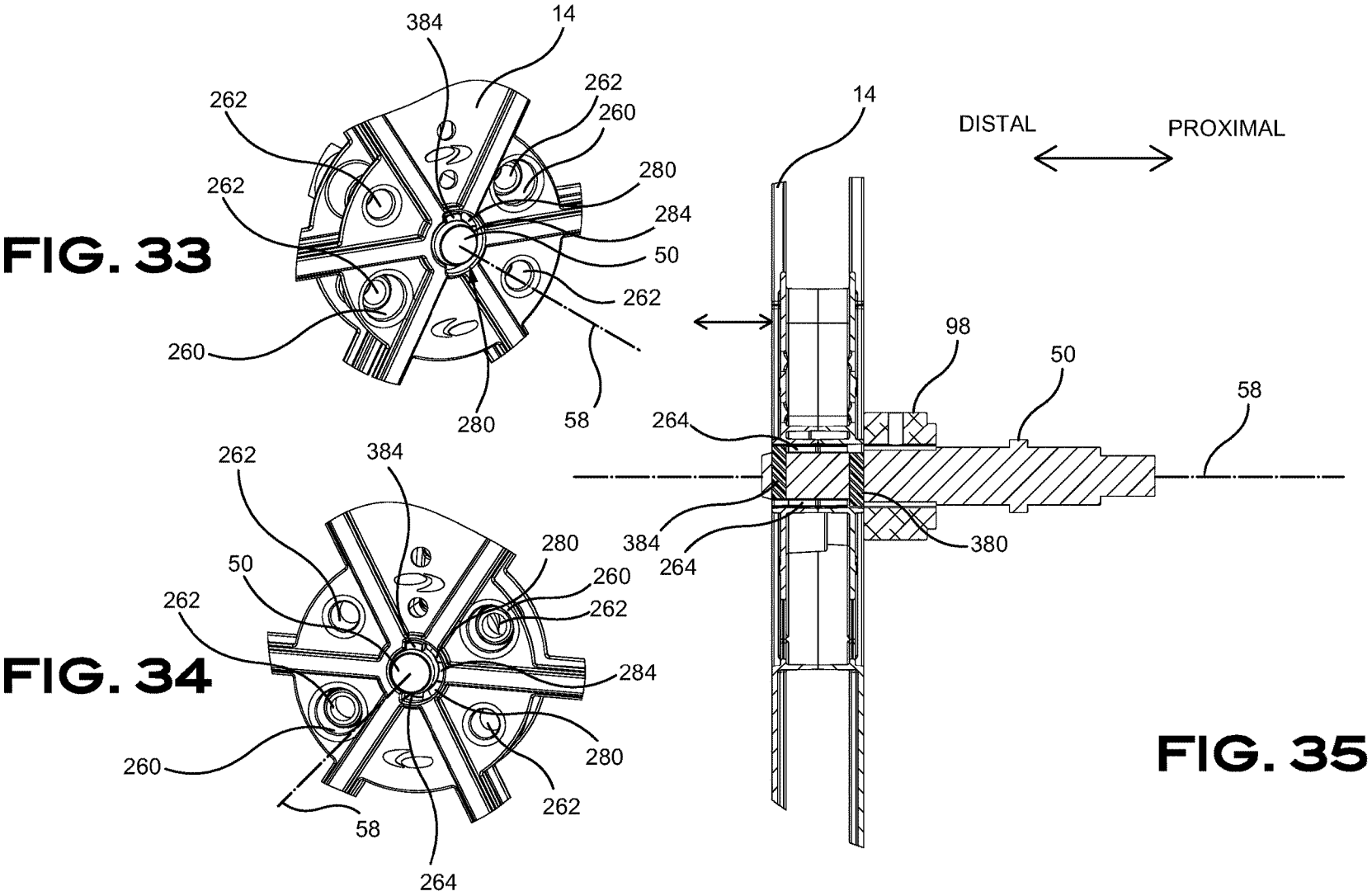
FIG. 33 is an isometric view of a portion of the spool and the spool-engaging member assembly, in accordance with at least one embodiment of the invention.
FIG. 34 is an isometric view of a portion of the spool and the spool-engaging member assembly, in accordance with at least one embodiment of the invention.
FIG. 35 is an elevation section view of the spool and the spool-engaging member assembly, in accordance with at least one embodiment of the invention.
Figure 38:
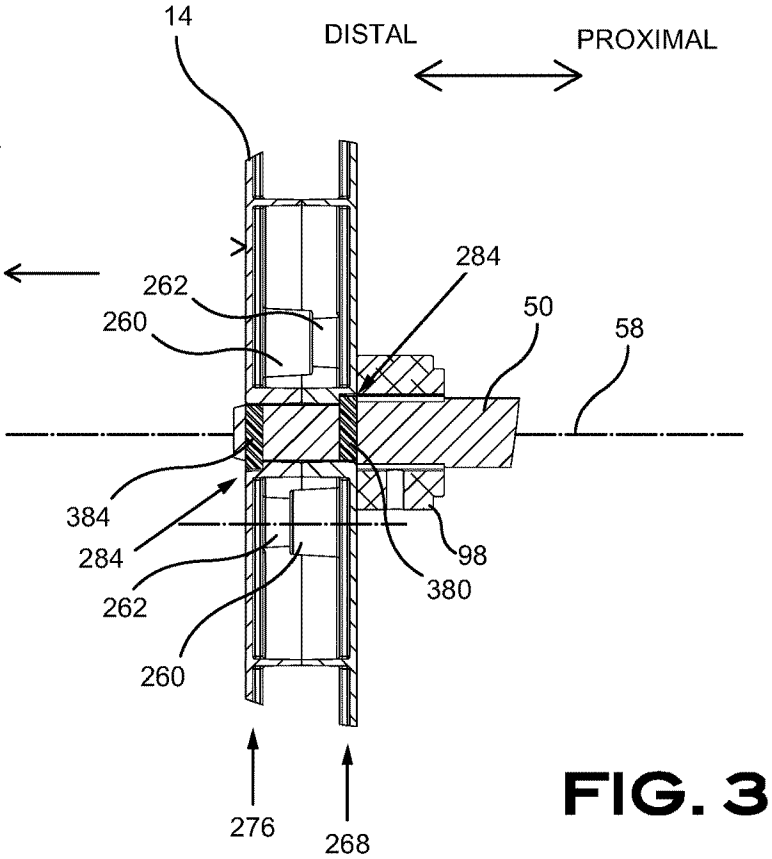
FIG. 38 is an elevation section view of the spool and the spool-engaging member assembly, in accordance with at least one embodiment of the invention.
Figure 36:
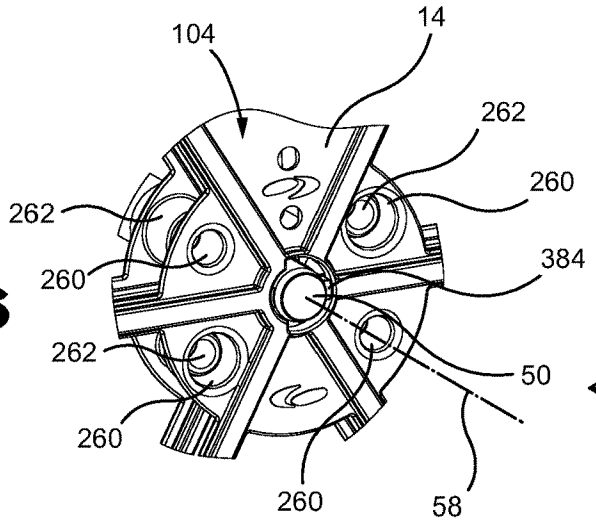
FIG. 36 is an isometric view of a portion of the spool and the spool-engaging member assembly, in accordance with at least one embodiment of the invention.
Figure 37:
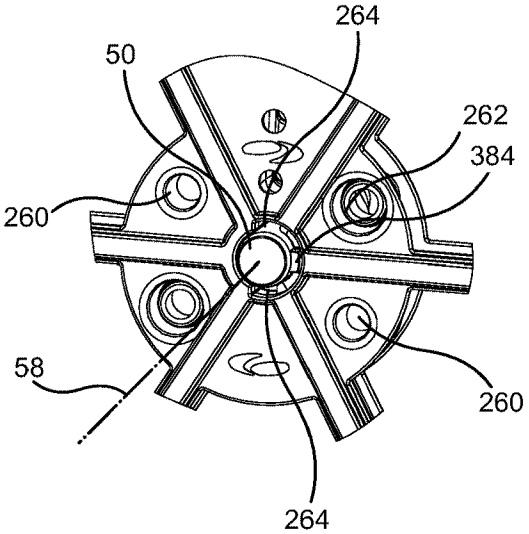
FIG. 37 is an isometric front elevational view of a portion of the spool and the spool-engaging member assembly, in accordance with at least one embodiment of the invention.

Moving now to FIG. 31 and FIG. 32 that illustrate an alternate embodiment of the spool-engaging member 50 and the spool 14. This embodiment is preferably usable with light spools 14 or with spools 14 made of strong material. Indeed, the spool-engaging member 50 includes a proximal slot-engaging member 380 and a distal slot-engaging member 384. Both slot-engaging members 380, 384 are engaging the spool's slots 264 in replacement of the torque member 308 of the previous embodiments. The slot-engaging members 380, 384 have a smaller contact area with the slots 264 of the spool 14 and can manage rotation of the spool 14. The spool-insertion configuration of this embodiment can be appreciated from FIG. 33, FIG. 34 and FIG. 35 while the spool-locking configuration is illustrated in FIG. 36, FIG. 37 and FIG. 38. A pivotal of the spool 14 is sufficient in this embodiment to secure the spool 14 to the spool-engaging member 50 since both slot-engaging members 380, 384 can engage their respective locking member receiver 284 with a fixed spool-contacting member 98. The slot-engaging members 380, 384 are aligned with their respective locking member receiver 284 when the spool 14 is installed on the spool-engaging member 50.

Figure 39:
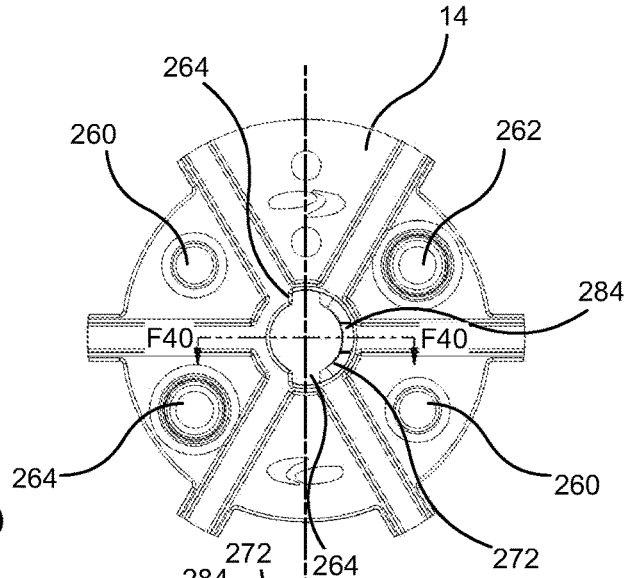
FIG. 39 is a front elevational view of the spool, in accordance with at least one embodiment of the invention.
Figure 40:
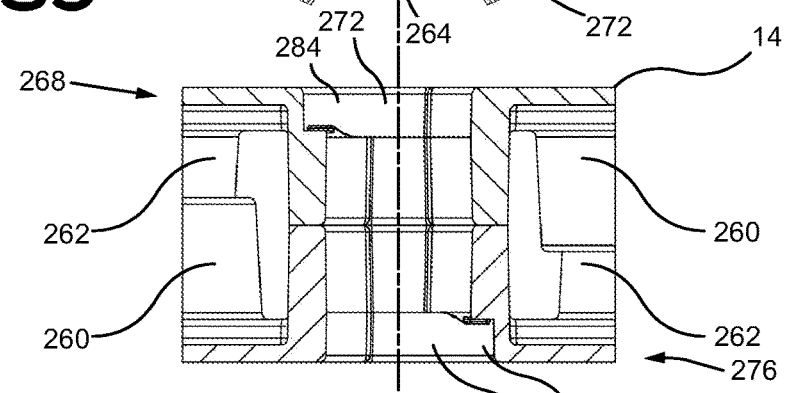
FIG. 40 is a side elevational section view of the spool, in accordance with at least one embodiment of the invention.
Figure 41:
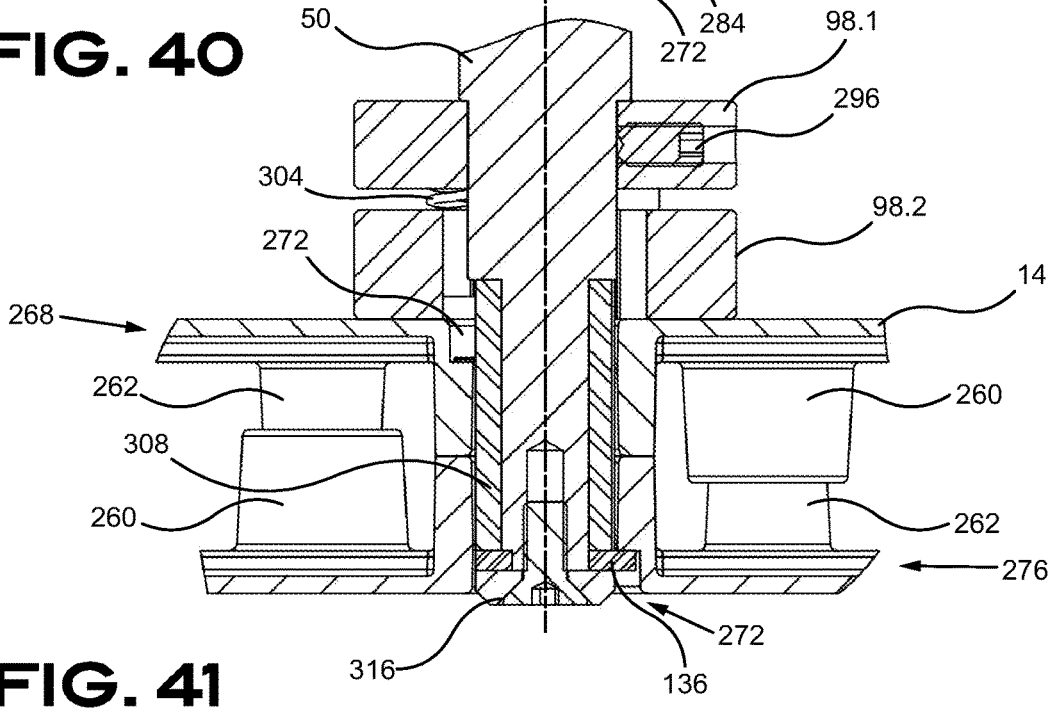
FIG. 41 is a side elevational section view of the spool and the spool-engaging member assembly, in accordance with at least one embodiment of the invention.

The spool 14 can be embodied to be reversible to be used in both sides in combination with the spool-engaging member 50. Referring to FIG. 39, FIG. 40 and FIG. 41, a reversible spool 14 is embodied with a recessed portion 272 and a locking member receiver 284 disposed on each side of the spool 14. The spool-engaging member 50 can then secure a spool 14 from either side thereof. This can be helpful to reduce handling of the spools 14 that do not have to be assembled in a specified side thereof. It can be appreciated the spool 14 is exemplified with two identical sides 268, 276 hence providing an additional advantage by requiring a single mold to produce both sides 268, 276 of a spool 14 in injected material such as plastic. Other manufacturing processes could alternatively be used for molding sides 268, 276 of a spool 14 without departing from the scope of the present specification.

Figure 44:
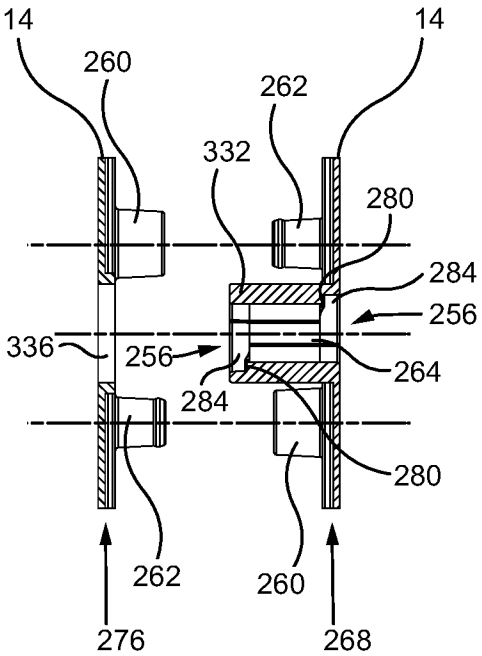
FIG. 44 is a section view of the spool of FIG. 42 in accordance with at least one embodiment of the invention.
Figure 43:
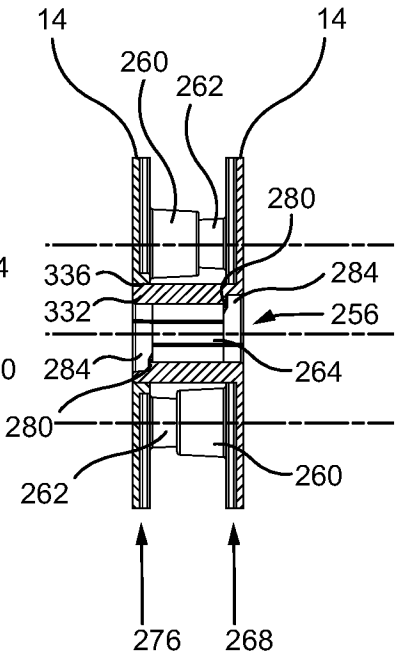
FIG. 43 is a section view of the spool of FIG. 42 in accordance with at least one embodiment of the invention.
Figure 42:
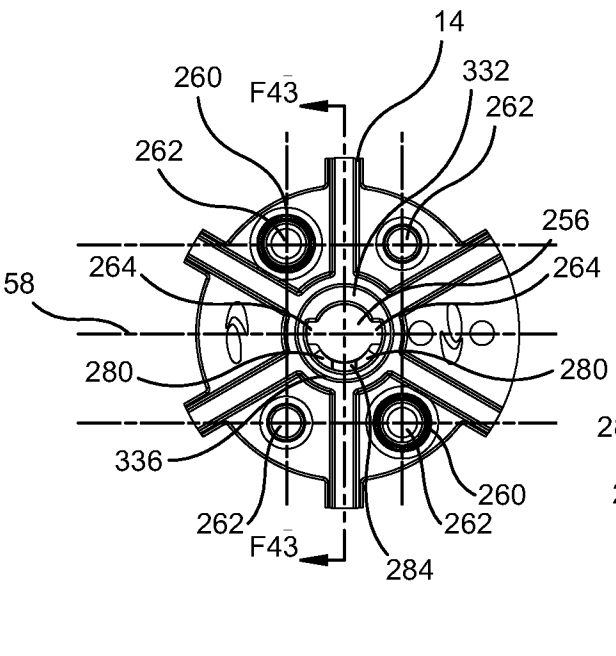
FIG. 42 is a side elevational view of a spool in accordance with at least one embodiment of the invention.

Another embodiment of the spool 14 is illustrated in FIG. 42 throughout FIG. 44. The proximal side 268 of the spool 14 of this embodiment includes an extended central portion 332 that is generally extending over the thickness of the spool 14. The distal side 276 of the spool 14 includes a central opening 336 sized and designed to mate with the extended central portion 332. The central opening 336, in a preferred configuration, is radially transmitting a load to the extended central portion 332. A pair of locking member receivers 284 are included in the extended central portion 332 to receive the locking member 136 therein when in a locked configuration. In the illustrated embodiment, the distal side 276 of the spool 14 can be disassembled from the proximal portion 268 when the spool 14 is secured on the spool-engaging member 50 when the proximal side 268 is proximally mounted on the spool-engaging member 50. Conversely, the illustrated spool 14 can be mounted in the opposite direction where the proximal side 268 of the spool 14 is distally mounted on the spool-engaging member 50. The embodiment depicted in FIG. 42 throughout FIG. 44 can include ramps 280 and could also be used without ramps 280 and use the temporary compression of the proximal side 268 toward the distal side 276 when engaging the locking member 136 in the locking member receiver 284.

Figure 47:
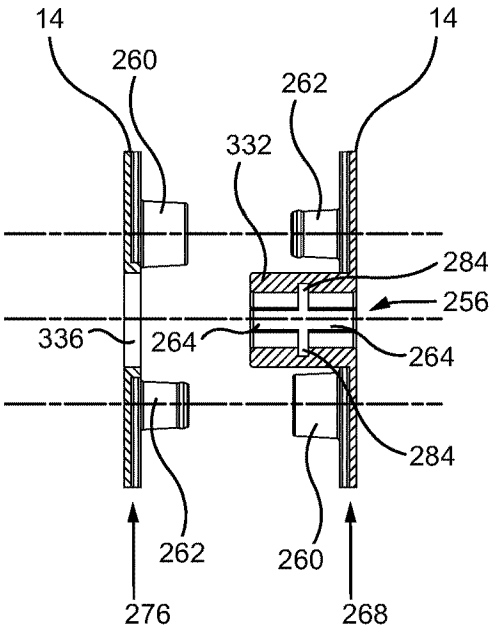
FIG. 47 is a section view of the spool of FIG. 42 in accordance with at least one embodiment of the invention.
Figure 46:
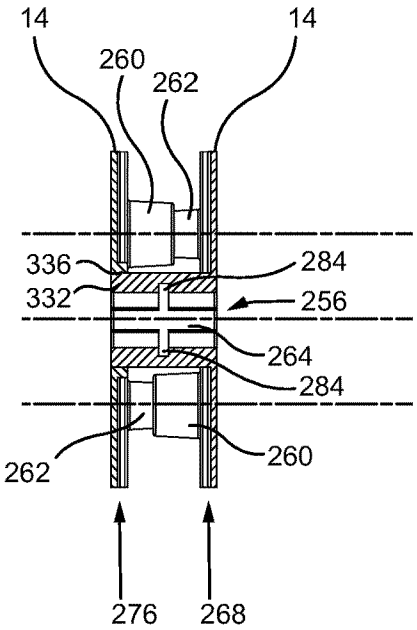
FIG. 46 is a section view of the spool of FIG. 42 in accordance with at least one embodiment of the invention.
Figure 45:
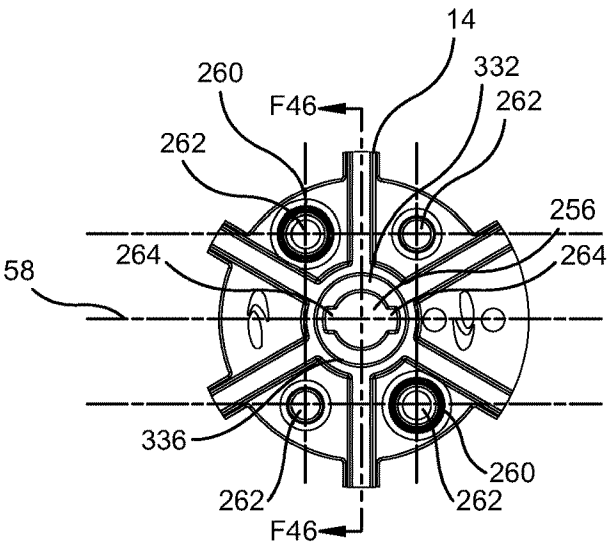
FIG. 45 is a side elevational view of a spool in accordance with at least one embodiment of the invention.

An alternate embodiment of the spool 14 is illustrated in FIG. 45 throughout FIG. 47. As indicated in the previous embodiment illustrated in FIG. 42 throughout FIG. 44, the proximal side 268 of the spool 14 of this embodiment includes an extended central portion 332 that is generally extending over the thickness of the spool 14. The distal side 276 of the spool 14 includes a central opening 336 sized and designed to mate with the extended central portion 332. The central opening 336, in a preferred configuration, is radially transmitting a load to the extended central portion 332. A pair of locking member receivers 284 are included inside the extended central portion 332 to receive the locking member 136 therein when in the locked configuration. The locking member 136 is inserted in the slot 264 and axially pushed to reach the locking member receiver 284 to be pivoted in the locking member receiver 284 to be secured therein. The locking member receiver 284 is axially located in the extended central portion 332 and is embodied axially halfway in the extended central portion 332 to allow securing the spool 14 on the spool-engaging member 50 on both sides. The locking member receiver 284 could be located at a different distance that could prevent the reversal use of the spool 14. Two locking member receiver 284 could be respectively axially located at a same distance from each side of the spool 14 in another embodiment. In the illustrated embodiment, the distal side 276 of the spool 14 can be disassembled from the proximal portion 268 when the spool 14 is secured on the spool-engaging member 50 when the proximal side 268 is proximally mounted on the spool-engaging member 50. Conversely, the illustrated spool 14 can be mounted in the opposite direction where the proximal side 268 of the spool 14 is distally mounted on the spool-engaging member 50. The embodiment depicted in FIG. 45 throughout FIG. 47 can include ramps 280, however, this would increase the manufacturing complexity. The embodiment illustrated in FIG. 45 throughout FIG. 47 could also be used without ramps 280.

Figure 48:
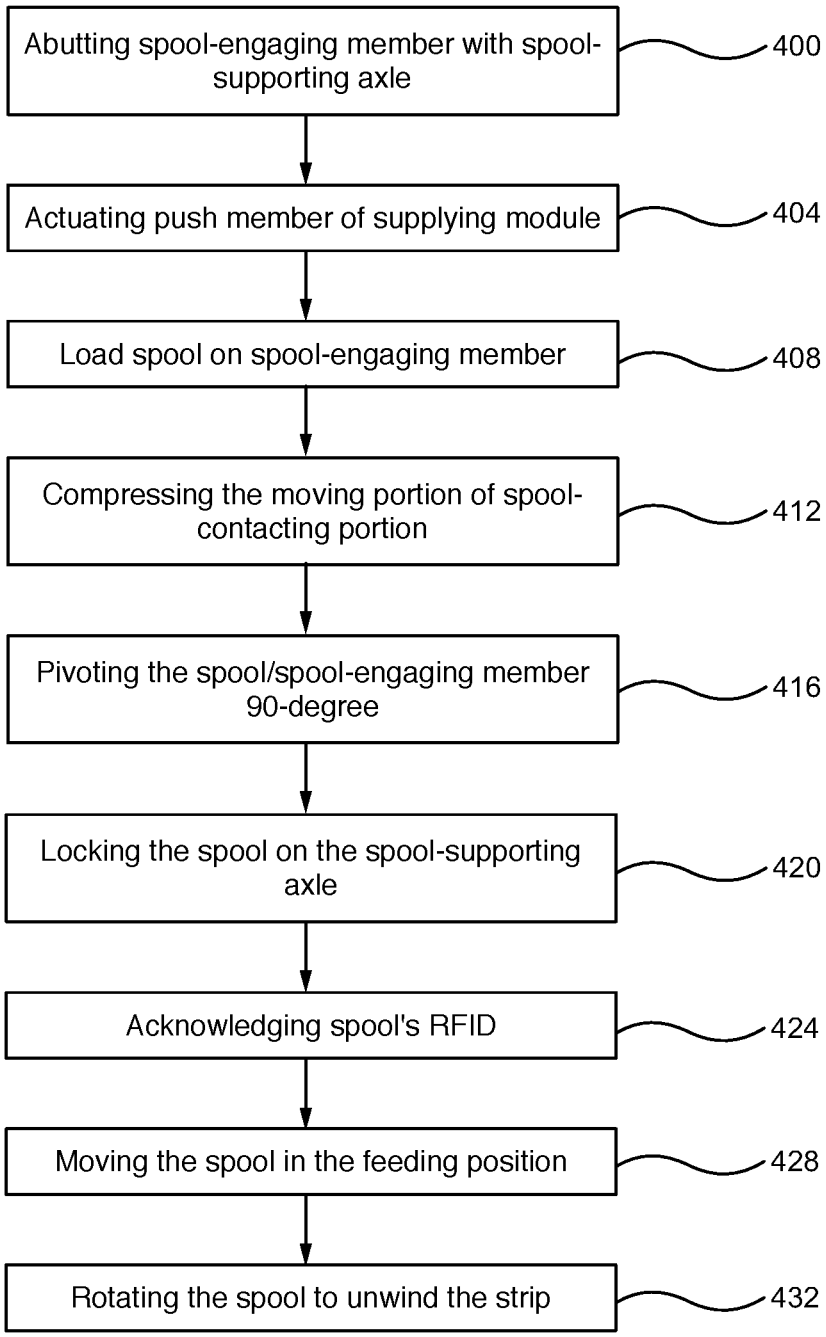
FIG. 48 is a flow chart exemplifying a process in accordance with at least one embodiment of the invention.
Figure 49:
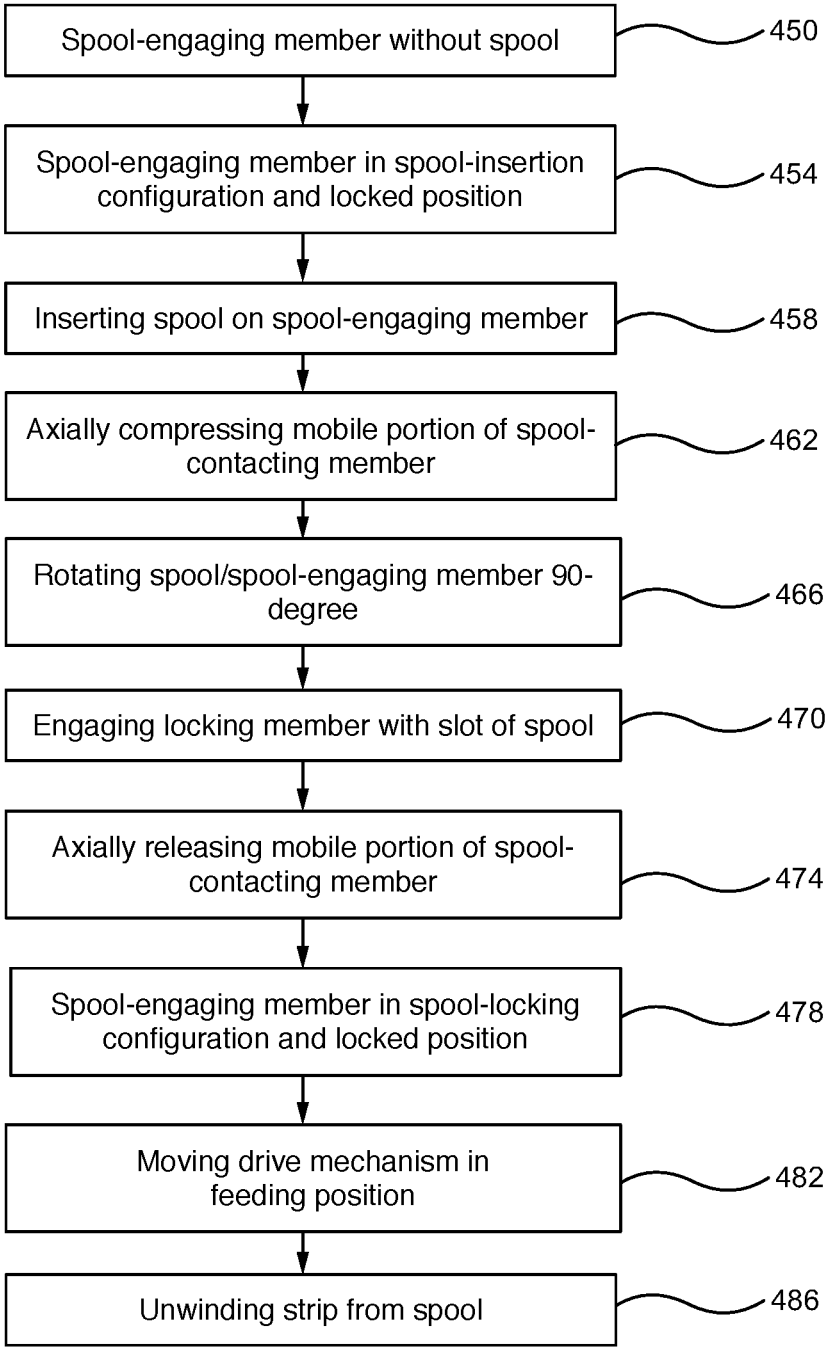
FIG. 49 is a flow chart exemplifying a process in accordance with at least one embodiment of the invention.

Two illustrative flow charts are provided in FIG. 48 and FIG. 49. FIG. 48 exemplifies a series of steps for loading a spool from the spool-supporting axle of the drive mechanism 22 to the spool-engaging member 50. In so doing, the spool-engaging member is moved in abutment with the spool-supporting axle 400 from where the push member is actuated 404 to transfer a spool from the supporting axle to the spool-engaging member 408. The spool is proximally pushed on the spool-engaging member to compress the moving portion of the spool-contacting portion 412 to allow pivotal of the spool 416 to lock the spool on the spool-supporting axle 420. The RFID of the spool is acknowledged 424 to then move the spool in the feeding position 428 and unwinding the strip 432 to provide the parts on the spool to the assembly process.

The flow chart of FIG. 49 exemplifies a series of steps for loading a spool 14 to the spool-engaging member 50 to the unwinding of the spool 14. The process begins with an empty spool-engaging member 450 that is in the spool-receiving configuration and the locked position 454 on which is inserted a spool 458. A compression of the moving portion of the spool-contacting member 462 to get in the unlocked position to rotate the spool 466 to engage the locking member with the slot of the spool 470 and axially releasing the mobile portion of the spool-contacting member 474 in the spool-locking configuration and the locked position 478. The spool is then engaged with the spool-engaging member that is ready to move the spool in the feeding position 482 to unwind the strip from the spool 486.

Additional claim language directed to embodiments of the invention could read as follow: a spool-supporting shaft comprising a shaft including a rotational axis thereof, an apparatus engaging portion located toward a first side of the shaft and a spool-supporting portion located toward a second side of the shaft, the spool-supporting portion comprising a first radial protrusion radially extending from the shaft in a first direction, a second radial protrusion radially extending from the shaft in a second direction and a spool-receiving portion between the first radial protrusion and the second radial protrusion. Wherein the protrusions include a rectangular section. Wherein the protrusions include a generally flat surface on axially facing surfaces thereof. Wherein the first direction and the second direction are angularly spaced with a 180-degree angle. Wherein the radial protrusions are assembled to the shaft. Wherein the radial protrusions are part of the shaft. Wherein the second radial protrusion is adjacent to a shoulder.

Other additional claim language directed to embodiments of the invention could read as follow: a spool-securing assembly comprising a spool-supporting shaft comprising a shaft including a rotational axis thereof, an apparatus engaging portion located toward a first side of the shaft and a spool-supporting portion located toward a second side of the shaft, the spool-supporting portion comprising a first radial protrusion radially extending from the shaft in a first direction, a second radial protrusion radially extending from the shaft in a second direction and a spool-receiving portion between the first radial protrusion and the second radial protrusion, the spool-supporting shaft being adapted to cooperate with a spool comprising a pair of opposed spool sides, each spool side including an axial shaft receiving opening aligning together when the spool sides are assembled together in opposition with each other and a pair of axial slots communicating with the central shaft receiving opening, the axial slots being sized and designed to axially translate therein the first radial protrusion. Wherein each of the spool sides comprises an axial recessed protrusion-receiving portion sized and designed to receive therein a radial protrusion when the spool is engaged on the spool-supporting shaft, between the pair of radial protrusions, and rotated about the spool-supporting shaft to angularly rotate the radial protrusions from the pair of axial slots to the axial recessed protrusion-receiving portions to secure the spool on the spool-supporting shaft. Wherein the pair of opposed spool sides is axially compressed between the first radial protrusion and the second radial protrusion when the first radial protrusion and the second radial protrusion are engaged with the axial recessed protrusion-receiving portions.

While the invention has been described in connection with what is presently considered to be the most practical and preferred embodiments, it is to be understood that the invention is not to be limited to the disclosed embodiments and elements, but, to the contrary, is intended to cover various modifications, combinations of features, equivalent arrangements, and equivalent elements included within the spirit and scope of the appended claims. Furthermore, the dimensions of limiting, and the size of the components therein can vary from the size that may be portrayed in the figures herein. Thus, it is intended that the present invention covers the modifications and variations of the invention, provided they come within the scope of the appended claims and their equivalents.

What is claimed is:

1. A spool comprising:

a rotation axis;

a proximal side orthogonal to the rotation axis;

a distal side orthogonal to the rotation axis with an intervening distance with the proximal side to receive a strip of material therebetween;

a central opening coaxial with the rotation axis and extending through the spool between the proximal side and the distal side;

an axial slot axially extending through the spool and radially extending from the central opening for slidably receiving therein a locking member when the spool is engaged by a support shaft;

a locking member receiver radially located and recessed in the distal side of the spool for securing therein the locking member radially extending from the support shaft; and a recessed portion adjacent to the central opening in the distal side of the spool and communicating with the central opening between the axial slot and the locking member receiver, the recessed portion restricting an angular pivotal movement of the locking member when the locking member has been axially engaged through the axial slot and extending through the spool toward the distal side of the spool for securing the locking member in the locking member receiver.

2. The spool of claim 1, wherein the central opening is between 15 mm and 18 mm in diameter.

3. The spool of claim 1, wherein the proximal side and the distal side of the spool further comprise a plurality of assembly openings, the plurality of assembly openings being connected together.

4. The spool of claim 1, wherein the axial slot includes a width of between 5 mm and 7 mm.

5. The spool of claim 1, wherein the proximal side and the distal side of the spool are substantially identical.

6. The spool of claim 1, wherein the recessed portion further includes a ramp between the axial slot and the locking member receiver.

7. The spool of claim 6, wherein the ramp is embedded deeper in the spool toward the axial slot and raising toward the distal side of the spool closer to the locking member receiver.

8. The spool of claim 7, wherein the ramp is forming an edge of the locking member receiver.

9. The spool of claim 1, wherein the proximal side and the distal side are generally circular and include a plurality of radially extending branches.

10. The spool of claim 1, further comprising a radially disposed angular locating member receiver.

11. The spool of claim 1, further comprising an RFID therein.

12. The spool of claim 1, wherein the spool includes a polymer.

13. The spool of claim 1, wherein the locking member receiver is a first locking member receiver and the spool further includes a second locking member receiver disposed in an opposite angular direction from the axial slot.

14. The spool of claim 13, wherein the second locking member receiver is substantially angularly opposed to the first locking member receiver.

15. The spool of claim 14, wherein the recessed portion is angularly extending over about 180-degree.

16. The spool of claim 1, wherein the locking member receiver is angularly disposed at about 90-degree from the axial slot.

* * * * *